US006871381B1

(12) United States Patent
Luca

(10) Patent No.: US 6,871,381 B1
(45) Date of Patent: Mar. 29, 2005

(54) DOOR CLOSURE WITH ADJUSTING MECHANISM FOR CONTROLLING DOOR CLOSING SPEED

(76) Inventor: Valentin Luca, 1157 Melville Ave., Fairfield, CT (US) 06825

( * ) Notice: Subject to any disclaimer, the term of this patent is extended or adjusted under 35 U.S.C. 154(b) by 64 days.

(21) Appl. No.: 10/446,893

(22) Filed: May 28, 2003

(51) Int. Cl.[7] ..... E05F 3/10
(52) U.S. Cl. ..... 16/52; 16/66; 16/84; 16/58
(58) Field of Search ..... 16/52, 51, 57, 16/58, 66, 72, 76, 84

(56) References Cited

U.S. PATENT DOCUMENTS

| | | | | | |
|---|---|---|---|---|---|
| 2,453,956 | A | * | 11/1948 | Angell | 16/66 |
| 3,249,961 | A | * | 5/1966 | Quinn | 16/66 |
| 3,708,826 | A | * | 1/1973 | Larson | 16/52 |
| 3,781,943 | A | * | 1/1974 | Cain | 16/52 |
| 4,178,655 | A | * | 12/1979 | Little | 16/52 |
| 4,358,870 | A | * | 11/1982 | Hong | 16/53 |
| 4,844,567 | A | * | 7/1989 | Chalabian | 312/139 |
| 5,163,204 | A | * | 11/1992 | Jackson | 16/84 |
| 5,456,283 | A | * | 10/1995 | Schap | 137/514.7 |
| 5,630,248 | A | | 5/1997 | Luca | |
| 5,832,562 | A | | 11/1998 | Luca | |
| 5,842,255 | A | | 12/1998 | Luca | |

FOREIGN PATENT DOCUMENTS

| | | | |
|---|---|---|---|
| DE | 3521705 | A1 * | 12/1986 |
| GB | 2108576 | A * | 5/1983 |
| JP | 2001214661 | A * | 8/2001 |
| JP | 2002013343 | A * | 1/2002 |

* cited by examiner

*Primary Examiner*—Chuck Y. Mah
(74) *Attorney, Agent, or Firm*—Fattibene & Fattibene; Arthur T. Fattibene; Paul A. Fattibene

(57) ABSTRACT

A readily adjustable door closure for varying the rate of speed at which an associated door may close which is effected by rotating the piston rod relative to the piston and associated cylinder assembly so as to vary the rate of flow of an actuating fluid flowing from one side of the piston to the other side of the piston, which controls the door closing speed accordingly.

35 Claims, 17 Drawing Sheets

DOOR CLOSURE WITH ADJUSTING MECHANISM FOR CONTROLLING DOOR CLOSING SPEED

FIELD OF THE INVENTION

This invention relates generally to door closures, and more specifically to a door closure having an adjusting mechanism for controlling or adjusting the speed at which a door closes toward a door closed position.

BACKGROUND OF THE INVENTION

Various types of door closures are known. Reference is made to U.S. Pat. Nos. 5,630,248; 5,832,562 and 5,842,255 to evidence some of the more recently known types of door closures.

Generally, the known door closures include a cylinder having reciprocally mounted therein a piston and a connected piston rod which extends through one end of the cylinder. The piston is normally biased toward a door closing position by a compression spring acting on the piston. With the end of the piston rod that protrudes out of one end of the cylinder and the opposite end of the cylinder suitably connected between the door frame and the door, the arrangement is such that upon opening of the door, the spring is compressed. The compression spring, acting on the piston in its compressed state, functions to return the door toward the closed position as the door is released upon the opening thereof.

Normally, in the known door closures, the speed at which the door is returned to its closed position was affected by controlling the flow rate of the fluid, i.e. pneumatic or hydraulic, out of the cylinder space opposed to the piston and closed by the piston.

In the event the operating fluid is air, the most commonly used system for controlling closing speed, was to provide an adjustable metering screw to adjust the rate at which air is permitted to escape from the cylinder through a relief hole metered by the adjusting screw.

In the event the operating fluid is a liquid, the most commonly used system to adjust the closing speed was effected by turning the piston while the piston rod is essentially maintained in a fixed position, the rotation of the piston being affected by rotating the entire cylinder around its centerline to control the speed closing rate.

It has been noted that rotating the cylinder about its centerline was not practical for door closures that are provided with other features, e.g. push-button type mechanisms, which require the cylinder to be maintained with a specific orientation at all times. Also, rotation of the cylinder to control the liquid flow rate may require additional seals for the piston.

SUMMARY OF THE INVENTION

An object of this invention is to provide a door closure assembly that allows for the adjusting or controlling the closing speed of a door closure by effecting the rotation of the piston rod relative to a stationary piston and cylinder assembly.

Another object is to provide a piston-cylinder door closure having a piston rod rotatably connected relative to the piston and the piston rod supporting bracket for controlling or adjusting the closing speed of an associated door.

Another object is to provide in a piston-cylinder type door closure a piston rod adjustably connected to the piston which is formed with one or more metering channels for adjustably controlling the flow of actuating fluid from one side to the other side of the piston to regulate the closing speed of the piston.

Another object of this invention is to provide a piston-cylinder type door closure with a connecting bracket having a coupling member for supporting the extended end of the piston rod in a manner to render the piston rod rotatable relative to the coupling member and the associated piston to effect the speed adjustment.

The foregoing objects, advantages and other features of the invention are attained in a door closure having a cylinder and piston assembly in which a piston and connected piston rod is reciprocally displaceable within the cylinder, the piston rod having one end projecting beyond the end of the cylinder. A compression spring is disposed about the piston rod between the piston and one end of the cylinder whereby the compression spring normally biases the piston toward the door closing position. The extended end of the piston rod is connected to a bracket which may be connected to a door frame with the other end of the cylinder being suitably connected to the door or door bracket. The arrangement is such that as the door is moved toward the open position, the compression spring is compressed. Upon the release of the door, the compression spring in its compressed state acting on the piston, functions to return the door toward the closed position upon release of the door.

In accordance with this invention, the rate or speed at which the door may close may be adjusted by merely rotating the piston rod relative to the piston. This is achieved by threading one end of the piston rod in a tapped or thread hole formed in the piston. The threaded end of the piston rod is also formed with one or more channels which taper inwardly toward the inner end of the piston rod. The arrangement is such that the channeled and threaded end of the piston rod functions as a valve to control the flow of actuating fluid from one side of the piston to the other side of the piston, for adjusting the rate of closing speed accordingly.

The other or free end of the piston rod is rotatably connected to a coupler connected to a support bracket so that the piston rod can be readily rotated relative to the piston and cylinder to vary the amount of fluid flow which is permitted to flow from one side of the piston to the other side thereof.

This is attained by the piston rod being rotatably supported to a coupler which is connected to the supporting bracket whereby the piston rod is rendered readily rotatable between the coupler and the piston. The arrangement is such that the control speed can be effective simply by rotating the piston rod relative to the piston. As will be hereinafter described, the coupler means may take various forms.

To facilitate the rotation of the piston rod, a suitably adjusting hand knob, wheel or other suitable turning feature may be associated with the piston rod, e.g. a screwdriver slot or wrench grip, by which the rod may be manually rotated to effect the adjustment necessary to control or vary the closing speed of the door closure.

IN THE DRAWINGS

DETAILED DESCRIPTION OF THE PREFERRED EMBODIMENTS

Figure 1:
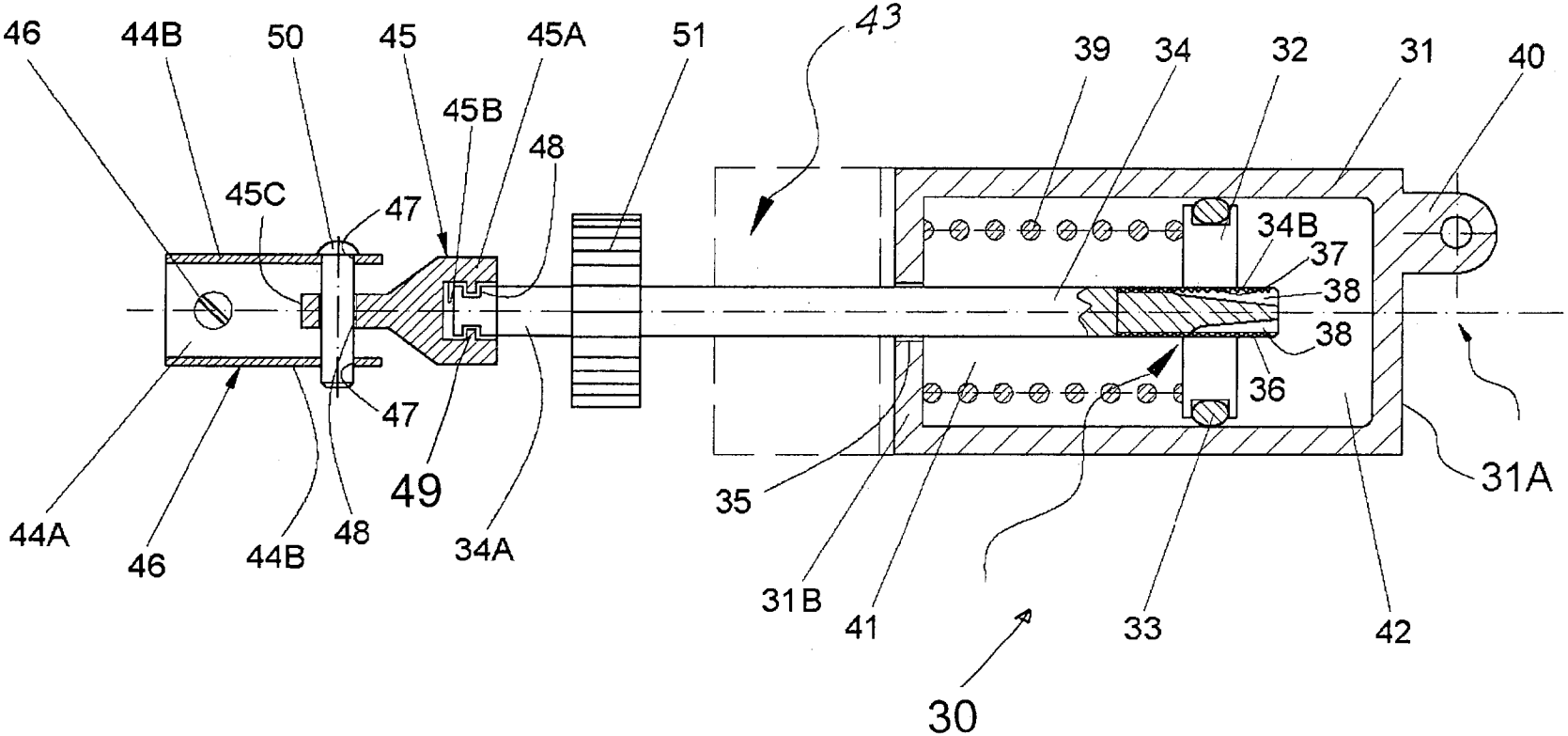
FIG. 1 is a side view of a door closure embodying the present invention and having parts shown in section.

Referring to the drawings, there is shown in FIG. 1 a door closure 30, which is shown partly in section. The relevant parts of a door closure 30 that relate to the instant invention include a cylinder 31 which is closed at one end or rear end 31A. A piston 32 is reciprocally disposed within the cylinder 31. A sealing means, e.g. a resilient O-ring type seal 33 or wiper seal, circumscribes the piston to form a piston seal. Connected to the piston 32 is a piston rod 34, the free end 34A extending or projecting outwardly through an opening 35 formed in the other or front end 31B of the cylinder 31. It will be understood that a suitable packing or seal is provided at opening 35 through which the piston rod 34 extends.

The other end 34B of the piston rod 34 adjustably connected to the piston 32, e.g. by threads 36 formed on the end of the rod and is adjustably threaded to a tapped hole 37 formed in the piston 32. The threaded portion or end portion 36 of the piston rod 34 is also provided with one or more circumferentially spaced apart longitudinal grooves or channels 38 which define a progressive or variable fluid passageway through the piston 32. Two such channels 38 are illustrated in the embodiment of FIG. 1.

Each channel 38 is inclined or tapered toward the central axis of the piston rod 32. The arrangement is such that the piston thread end 36 functions like a needle valve to vary or adjust the opening to the passageways defined by the channels 38 when the piston rod 34 is rotated in one direction or the other. For example, advancing the threaded end 36 of the piston rod 32 toward the front end 31A of the cylinder reduces the openings to the passageways 38 to restrict fluid flow, and retracting the threaded end 36 will enlarge the opening to the passageway to increase the fluid flow therethrough, thus controlling the rate of closing accordingly.

A compression spring 39 is disposed about the piston rod 34 between the piston 32 and end wall 31B of the cylinder. The other end wall 31A is provided with a lug 40 by which the end 31A of the cylinder 31 may be suitably connected to the cylinder mounting bracket (not shown) by which the cylinder is mounted, for example to either a door or to a door frame (not shown). The other end 34A of the piston rod 34 is connected to its supporting bracket, which is connected, for example, to a door frame or to the door in a manner as will be hereinafter described.

From the arrangement thus described and with the cylinder end 31A suitably connected to the door or to the door frame, the opening of the door (not shown) will cause the piston 32 to be displaced to the left as viewed in FIG. 1, causing the compression spring 39 to be compressed. As the spring 39 is being compressed, the fluid in chamber 41 formed between the piston 32 and end wall 31B will be forced out chamber 41 and to flow through the channels 38 and into the expanding chamber 42 formed between piston 32 and end wall 31A. If desired, a stopper means 43, schematically illustrated in FIG. 1, may be positioned on the extended portion of the piston 34 rod to arrest the door in a desired open position. Such stopper means 43 may comprise a slidable canting washer type of stop commonly used with door closures to selectively maintain the door in a predetermined opened position. However, the stopper means 43 is not critical to the instant invention and may constitute any other optional type of an arresting means. Other optional type arresting means or door latching means 43 are disclosed in my prior patents, e.g. U.S. Pat. Nos. 5,842,255 and 5,832,562, incorporated herein by reference.

Piston is provided with means to allow some flow 9 of fluid from 41 to 42 but essentially all fluid passes from 42 to 41 through channel 38. As the piston 32 is under the bias of the compression spring 39 during a door opening, it will be apparent that upon release of the door, the compression spring 39 will urge the piston 32 toward the door closing position. On closing, the fluid disposed in chamber 42, which is being compressed by the piston 32 being urged to a closing position, will be forced to flow primarily through the channel passageways 38 to the other side of the piston 32. The rate of fluid flow from one side of the piston 32 to the other side controls the rate of closing.

In accordance with this invention, the rate or speed of the door closure force can be controlled or adjusted simply by rotating the piston rod 34 relative to the piston 32 to control or regulate the size of the channels or passageways 38, depending upon the direction of rotation of the piston rod 34.

To render the piston rod 34 as described, rotatable relative to the piston 32 and its mounting bracket 44, an intermediate coupling means 45 is provided. The coupling means 45 is formed so that the end 34A of the piston rod 34 is rotatably coupled thereto.

In the embodiment of FIG. 1, a support bracket 44 in the form of a channel member having opposed spaced apart sides 44B interconnected by a web 44A is arranged to be connected, e.g. to a door frame (not shown). It will be understood that bracket 44 may take other forms such as an angle bracket or other suitable bracket to which the coupling means 45 may be connected. For example, the bracket 44 may be fixed to a door frame by means of suitable fasteners 46, e.g. screws, bolts, rivets or the like. The opposed sides 44B of the bracket 44 are formed with aligned holes 47 for receiving a bolt, screw or rivet by which the coupling means 45 is pivotally connected thereto.

In the embodiment of FIG. 1, the free end 34A of the piston rod 34 is provided with an annular groove 48. The coupler means 45 comprises a socket head 45A having a bore or recess 45B which is adapted to receive the grooved end of the piston rod 34. A retaining means 49, e.g. a split ring retainer or other suitable retainer, is disposed within the bore 45B of the socket head to secure the free end 34A of the piston rod. The arrangement is such that the piston rod 34 is able to be rotated relative to the intermediate coupling means 45 described and the piston 32.

The coupler means 45 also includes a mounting lug 45C which is disposed between the opposed sides 44B of the piston rod bracket 44 and is pivotally secured thereto by a bolt, rivet or other suitable fastener 50 which extends through the aligned bracket holes 47 and hole 48 in lug 45C.

To facilitate rotation of the piston rod 34 in one direction or the other relative to piston 32, to effect the adjustment of the channel passageways 38 to control the closing speed, a manual turn wheel or dial 51 is fixedly secured to the extended end of the piston rod. The arrangement is such that the piston rod 34 is then rendered readily rotatable relative to the piston 32 and the piston rod coupler means 45.

To adjust the closing speed of the door closure 30, one need only rotate the turn dial or wheel 51 in one direction or the other to rotate the piston rod 34 to effect the adjusting of the size or opening of the passageways defined by channels 38 to control closing speed.

It will be noted that in the door closure 30 described, the actuating fluid may be either air or liquid.

Figure 2:
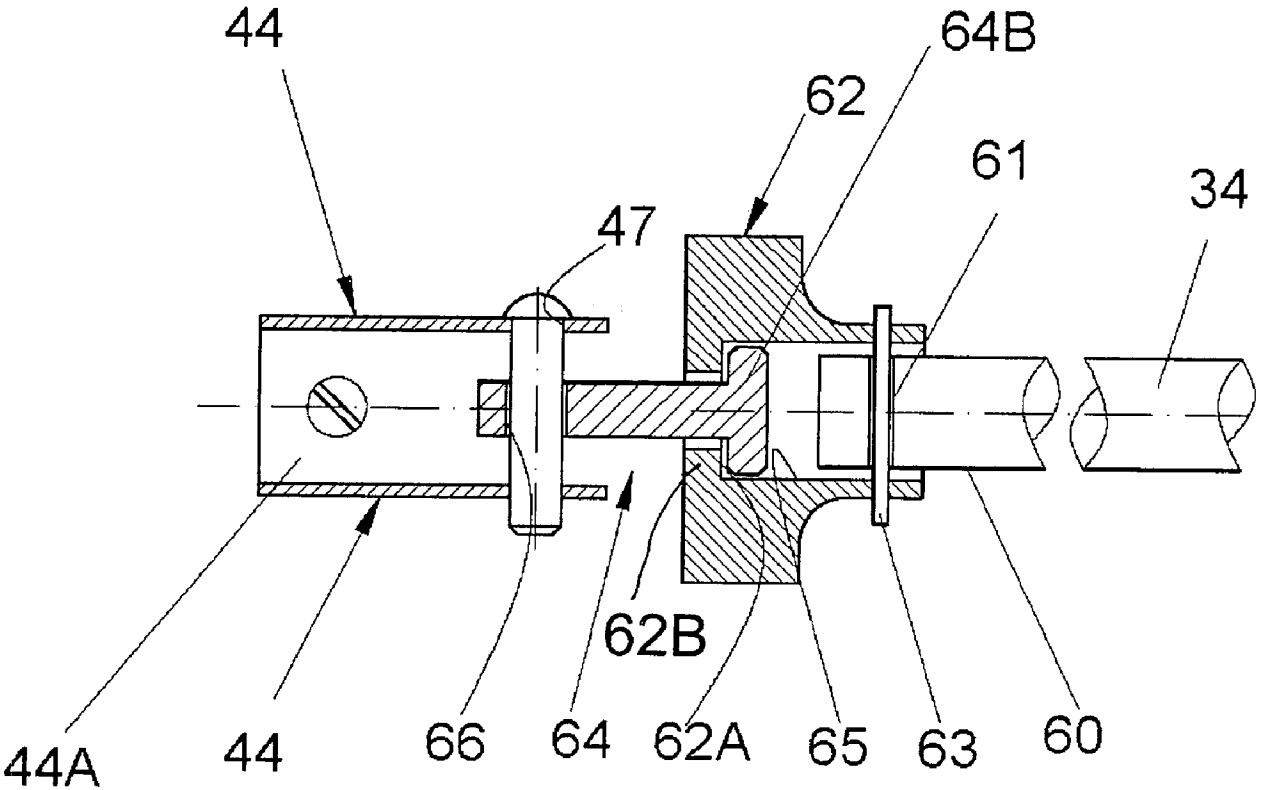
FIG. 2 is a side sectional view of a modified piston rod coupler detail.

FIG. 2 illustrates a modified form of the invention. The piston 32 and cylinder 31 assembly of this embodiment (not shown) is identical to that described with respect to the embodiment of FIG. 1, except as herein described. In this form of the invention, the free end 60 of the piston rod 34 is provided with a through hole 61 to which a hub 62 is secured by means of a lock pin 63. The hub 62 is provided with a bore 65 which extends therethrough. The hub is also formed with an inturned lip or flange 62A to define a reduced opening 62B at one end of the bore 65.

In this form of the invention, the coupling means 64 includes a pin having a shank portion 64A and a connected head portion 64B. The shank portion 64A is provided with a through hole 66 disposed in alignment with holes 47, 47 of bracket 44. A pin or bolt 47A pivotally secures the coupler pin 64 to the bracket 44. In the assembled position, the head portion 64B of the coupler means 64 is retained within the bore 65 of the hub 62 by the inturned lip 62B. The arrangement described permits the hub 62 to function as a manual turn knob or wheel to effect the rotation of the attached piston rod 34, as hereinbefore described with respect to the embodiment of FIG. 1.

Figure 3:
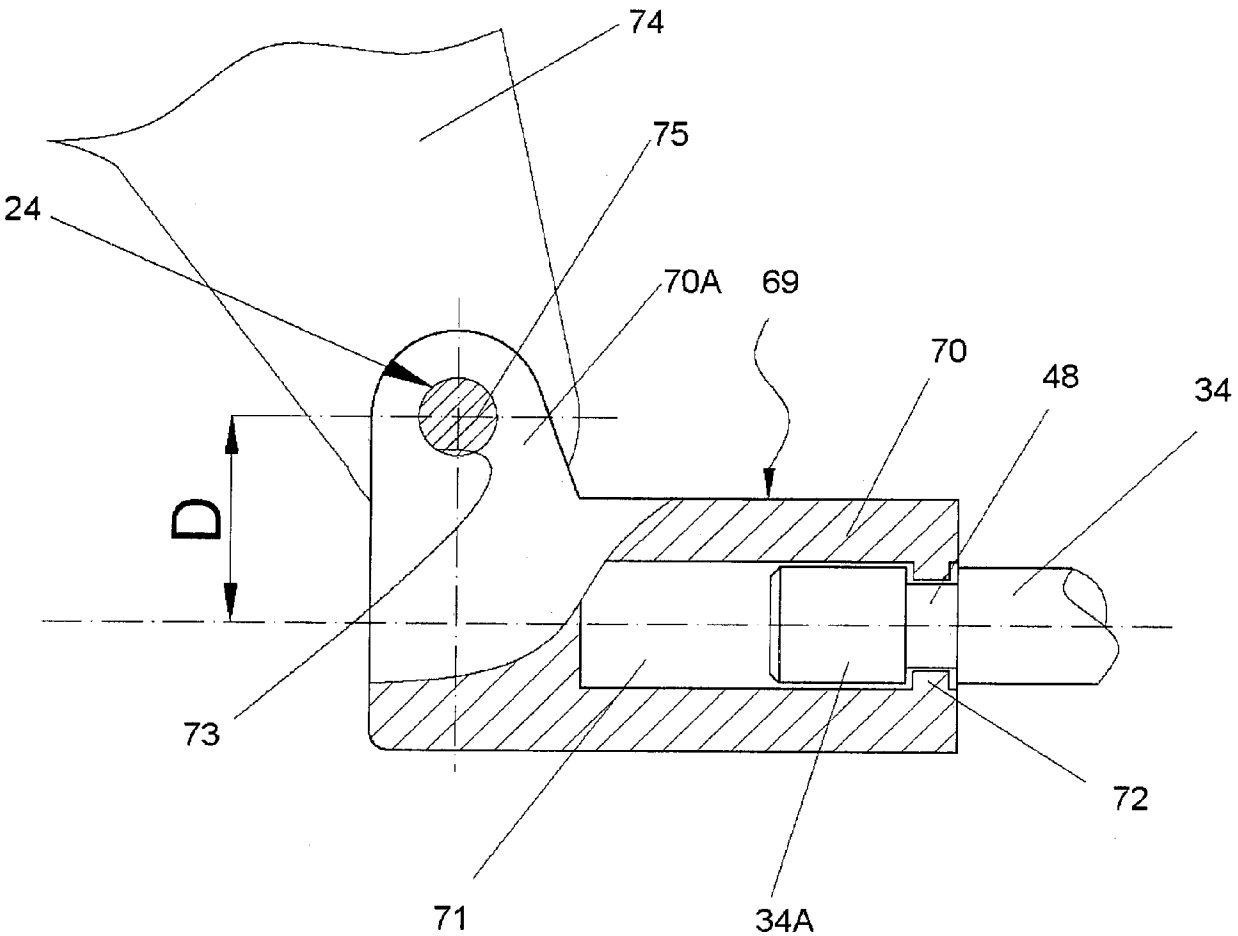
FIG. 3 is a side sectional view of another modified piston rod coupler means.

FIG. 3 depicts a further modified detail of a coupler means 69 to practice the invention. In this form of the invention, the piston and cylinder assembly portion (not shown) is similar to that described with respect to FIG. 1, except as noted herein. In this form of the invention, the piston rod 34 is provided with annular groove 48 adjacent the free end 34A of the piston rod 34 similar to that of FIG. 1. The coupler means 69 in this form of the invention includes a coupler member 70 having a bore 71 for rotatably receiving therein the free end 34A of the piston rod 34. The arrangement is such that the axis of the bore 71 is coincident with the longitudinal axis of the piston rod 34. An inturned lip 72 circumscribing the opening of the bore 71 is arranged to be received in the annular groove 48 to retain the free end 34A to the coupler member 70 in a manner which permits the piston rod 34 to be rotated relative to the coupler member 70.

The coupler member 70 is illustrated with a laterally offset portion 70A which may have one or more mounting holes 73 by which the coupler member 70 may be pivotally connected to a suitable bracket 74. However, depending on the type of mounting, the offset portion may not be necessary. In the illustrated embodiment, only one mounting hole 73 is shown. It will be understood that bracket 74 may be connected to either a door frame or the door depending on how the door closure is to be mounted therebetween. The coupler member 70 is pivotally mounted to its bracket 74 by means of a pivot pin or bolt 75. In the illustrated embodiment, the pivot hole or holes 73 are disposed or oriented essentially perpendicularly relative to the center line of the piston rod 34 and located at an offset distance D small enough to prohibit any canting or locking of the coupler member 70 to the piston rod when a force along the center line of the piston rod 34 is applied to the coupler member 70. In all other respects, this embodiment is similar to that described with respect to FIG. 1.

Figure 4:
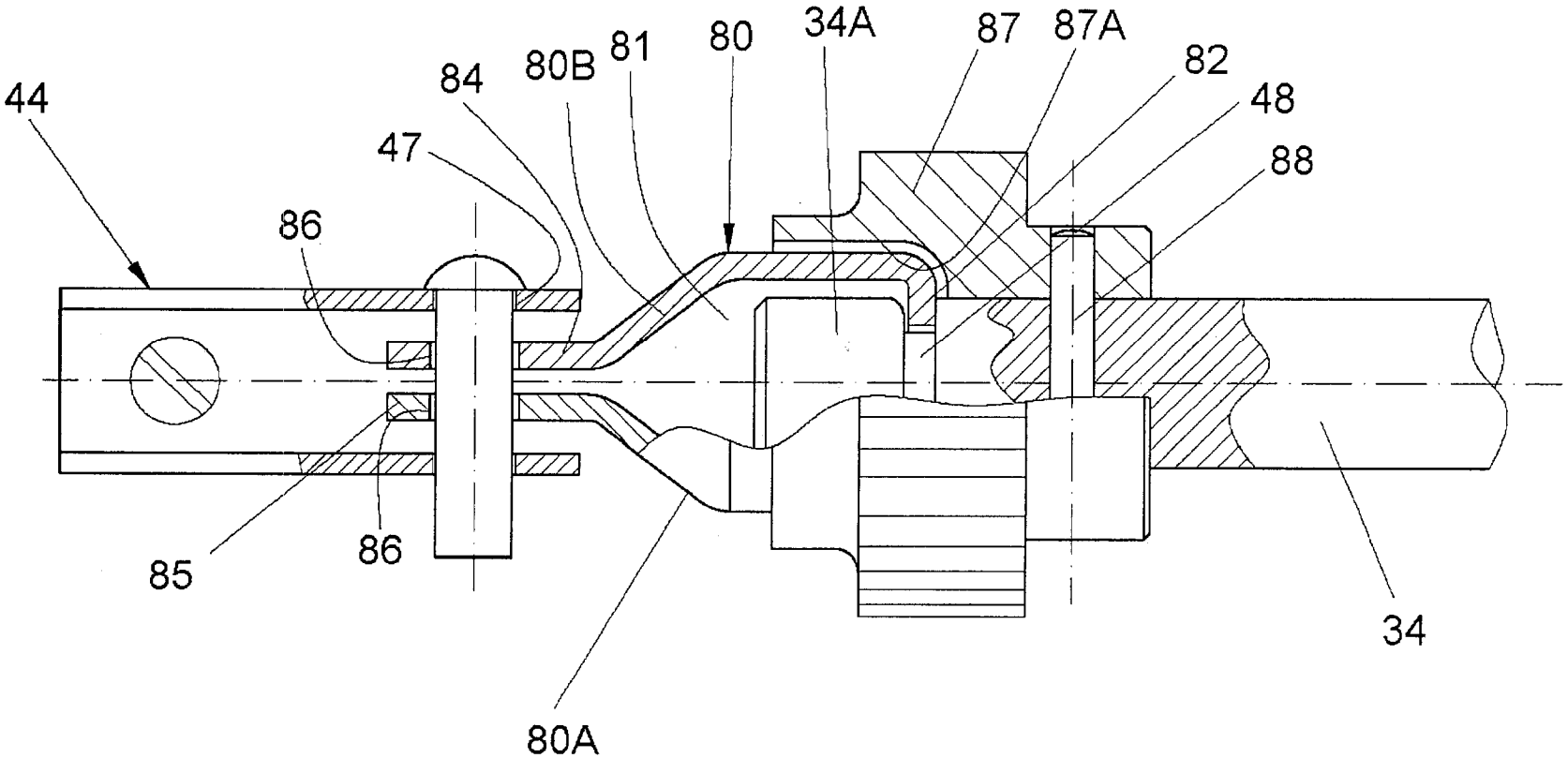
FIG. 4 is a side view of another modified piston rod coupler means which is shown partly in section.

FIG. 4 illustrates still another embodiment of the invention. In this embodiment, the piston and cylinder assembly is similar to that described with respect to the embodiment disclosed and described with respect to FIG. 1. Therefore, further description of the piston and cylinder assembly is not required, except as hereinafter noted. In this form of the invention, the piston rod 34 is provided with an annular groove 48 adjacent the free end 34A thereof similar to that previously described with respect to FIG. 1.

In this form of the invention, the coupler means 80 is made up of two components or parts, 80A and 80B, which are similar in shape. The two parts 80A and 80B are so shaped so as to define a socket 81, which is adapted to receive the free end 34A of the piston rod 34. Adjacent the front or open end of the socket 81, defined by the two parts 80A and 80B, the respective parts 80A and 80B are each provided with an inturned flange or lip 82 to define the socket opening which is adapted to receive the free end 34A of the piston rod 34. The piston rod 34 is rotatably coupled to the coupling means 80 by the engagement of the coupler lips 82 in the annular groove 48 of the piston rod 34.

The respective other ends 84, 85 of the complementary parts 80A and 80B are secured to the mounting bracket 44 by means of a pivot pin or bolt 50, which extends through aligned openings 47 formed in bracket 44 and aligned holes 86, 86 formed in the ends 84, 85 of parts 80A and 80B.

Connected to the piston rod, adjacent the annular groove 48, is a hub 87 which is in the form of an annular member which is secured or fixed to the piston rod 34 by means of a lock pin 88 or the like. The hub 87 is provided with a bore 87A, which is adapted to receive the front portions of the two coupler parts 80A and 80B. The bore 87A functions to retain the coupler two parts 80A and 80B in a manner to insure that the lips 82 are retained within the annular groove 48.

In the arrangement disclosed, the hub 87 functions or provides the means by which the piston rod 34 may be manually rotated relative to the coupling means 80 and the connected piston. In all other respects, the door closure of the embodiment disclosed in FIG. 4 is similar in structure and operation to that described with respect to the embodiment of FIG. 1.

Figure 5:
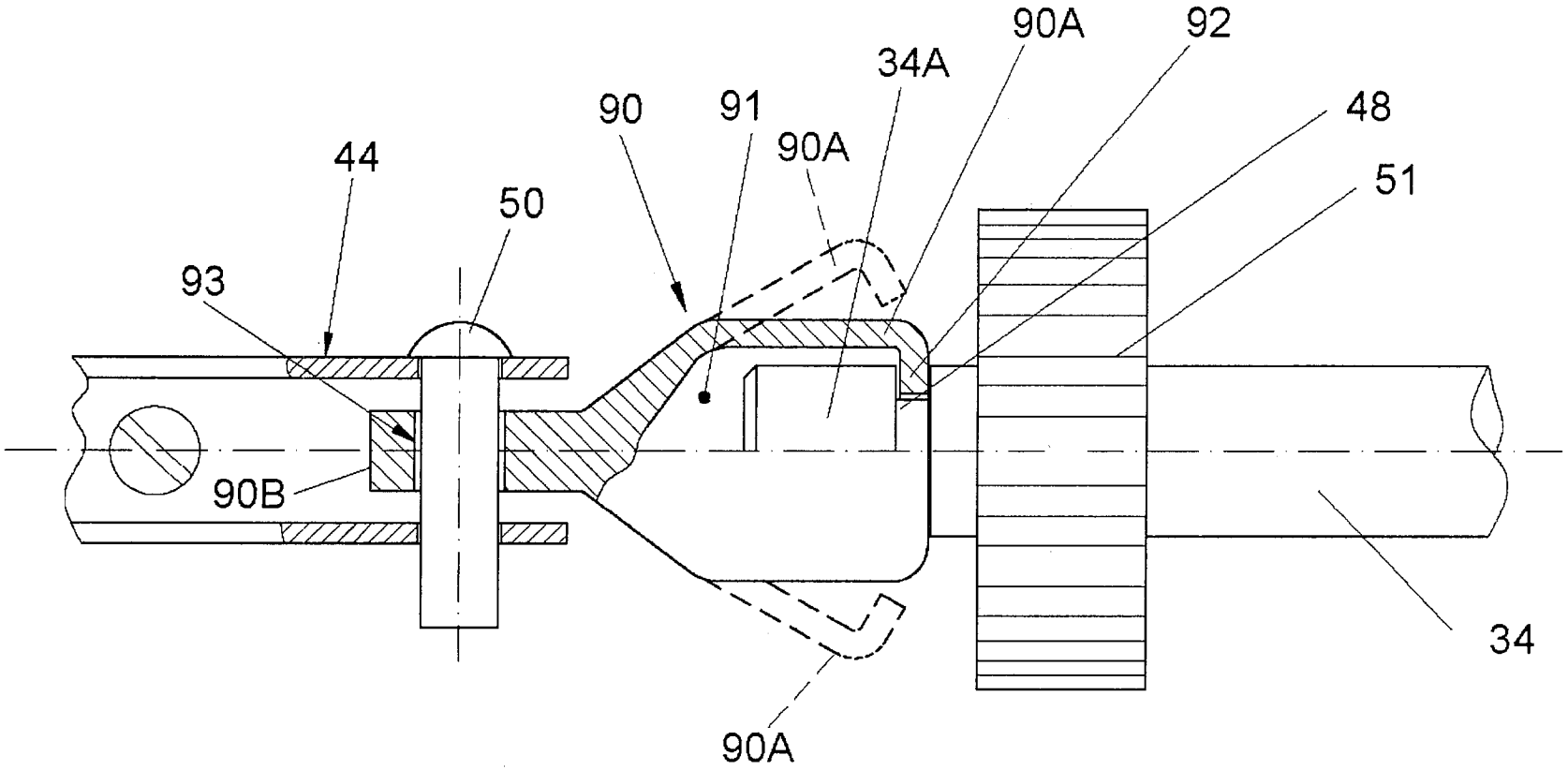
FIG. 5 is a side view of another modified piston rod coupler means showing parts in section.

FIG. 5 illustrates another modified embodiment of the invention. In this form, the invention is distinguished by the coupler means 90. In this form of the invention, the coupler means 90 is formed of a material which can be readily swedged or deformed for engaging the free end 34A of the piston in a manner to render the piston rod 34 rotatable in the assembled position. As shown, the coupler means 90 includes circumscribing wall portions or fingers 90A to define a socket 91 for receiving the free end 34A of the piston rod 34. The leading end of the circumscribing wall portion defining the socket 91 is formed with an inturned lip 92 which, when swedged, will engage the angular groove 48 formed adjacent the free end 34A of the piston rod 34.

To assemble the coupling means 90 onto the free end 34A of the piston rod 34, the free end 34A of the piston rod 34 is inserted into the socket 91 and the circumscribing wall portions 90A are then swedged or squeezed so that the circumscribing lip 92 is received within the angular groove 48 of the piston rod 34 and functions to retain the piston rod 34 so that it can be readily rotated. The coupler means 90 is also provided with a tail portion 90B extending from the socket 91, and which is formed with a transverse hole 93 whereby the coupler means 90 is pivotally secured to bracket 44 by a pivot pin or bolt 50. In all other respects, the piston and cylinder assembly of the embodiment of FIG. 5 is similar to that hereinbefore described with respect to FIG. 1.

Figure 6:
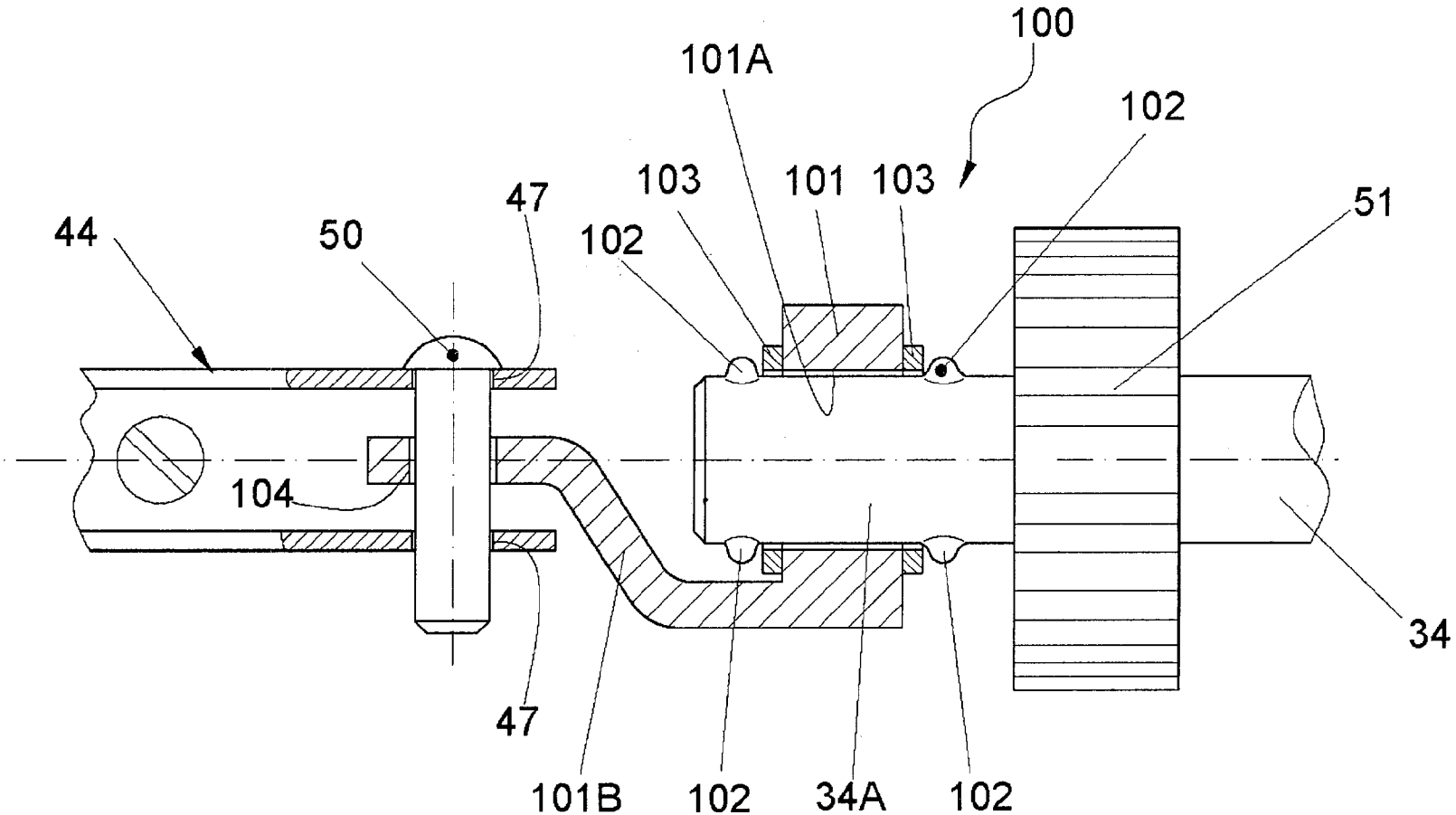
FIG. 6 is a side view of another modified piston rod coupler means having parts shown in section.

FIG. 6 is directed to another modified form of the invention. In this form of the invention, the door closure assembly is similar to FIG. 1 except that the coupling means 100 comprises a sleeve 101 having a bore 101A for receiving the free end 34A of the piston rod 34. In this form of the invention, the free end of the piston rod 34 is formed with spaced apart offsets or protrusions 102 retaining the sleeve 101 in position on the free end 34A of the piston rod 34. The arrangement is such that the piston rod 34 is rendered or retained in bore 101A so as to be readily rotatable within the bore of the sleeve 101. To facilitate relative rotation between the piston rod 34 and the sleeve 101, suitable washers 103 may be mounted on either end of the sleeve 101 between the sleeve end and the adjacent protrusion 102.

Integrally connected to the sleeve 101 is a laterally offset arm 101B which is provided with a through opening 104, which is arranged to be disposed in alignment with the openings 47, 47 of the mounting bracket 44. A suitable pivot pin, bolt or screw 50 secures the coupling means 100 to its mounting bracket 44. A manual hand wheel or dial 51 is fixedly secured to the piston rod 34 whereby one can effect rotation of the piston rod 34 to adjust the rate of closing speed in a manner as hereinbefore described with respect to the embodiment of FIG. 1. In all other respects, the operation and structure of the embodiment described in FIG. 6 is similar to that hereinbefore described with respect to the embodiment of FIG. 1.

Figure 7:
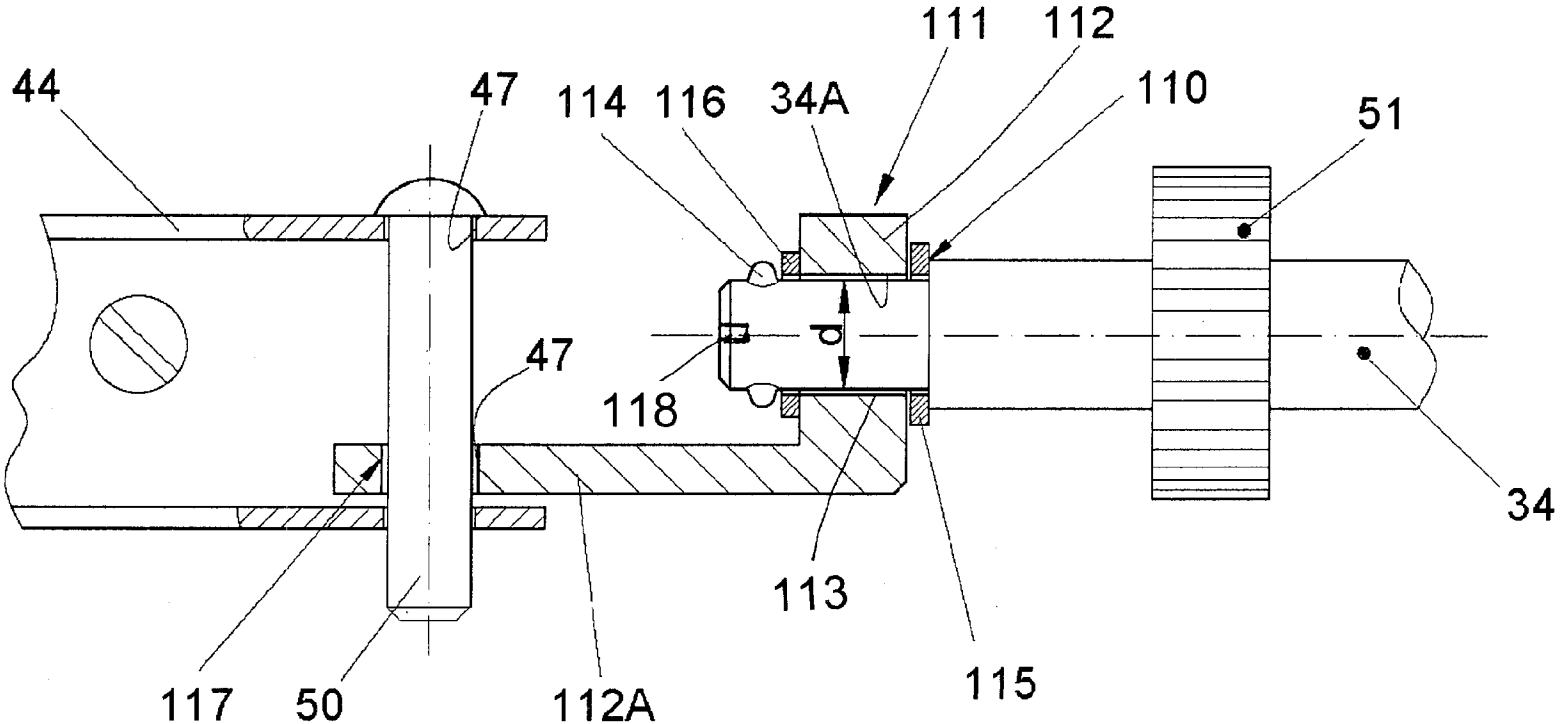
FIG. 7 is a side view of another modified piston rod coupler means having parts thereof shown in section.

FIG. 7 is directed to another coupler arrangement for use in a door closure embodying the present invention. The piston and cylinder assembly of the door closure of this embodiment is similar to that hereinbefore described with respect to the embodiment of FIG. 1 and therefore need not be repeated. However, in this form of the invention, the free end 34A of the piston rod 34 is provided with a reduced diameter "d" to define a shoulder 110. The coupling means 111 of this embodiment comprises a sleeve 112 having a bore 113 extending therethrough for receiving the reduced end portion 34A of the piston rod 34. As illustrated in FIG. 7, the sleeve 112 is retained between the shoulder 110 and end protrusions 114 formed at the end of the piston rod 34. If necessary, to facilitate for a rotation of the piston rod 34 relative to the sleeve 112, a suitable washer 115, 116 may be interposed between the shoulder 110 and the sleeve 112 at one end and between the other end of the sleeve 112 and the protrusion 114, respectively. A laterally extending arm 112A is connected to the sleeve 112 whereby the coupling means 111 can be pivotally connected to the bracket 44 by means of a pivot pin or bolt 50 being extended through aligned openings 47, 47 formed in the bracket 44 and aligned opening 117 in the lateral arm 112A. In all other respects, the construction of the door closure associated with the coupler means 111 of FIG. 7 is similar in structure and operation to that hereinbefore described with respect to the embodiment of FIG. 1. It will be understood that a turn wheel or dial, 51, may be fixedly secured to the piston rod 34 so as to facilitate the rotation of the piston rod 34 whenever one desires to adjust the rate of closure in a manner hereinbefore described. If desired, the rod 34 can be rotated by a screwdriver engaging a slot 118 formed on the free end of the piston rod 34.

Figure 8:
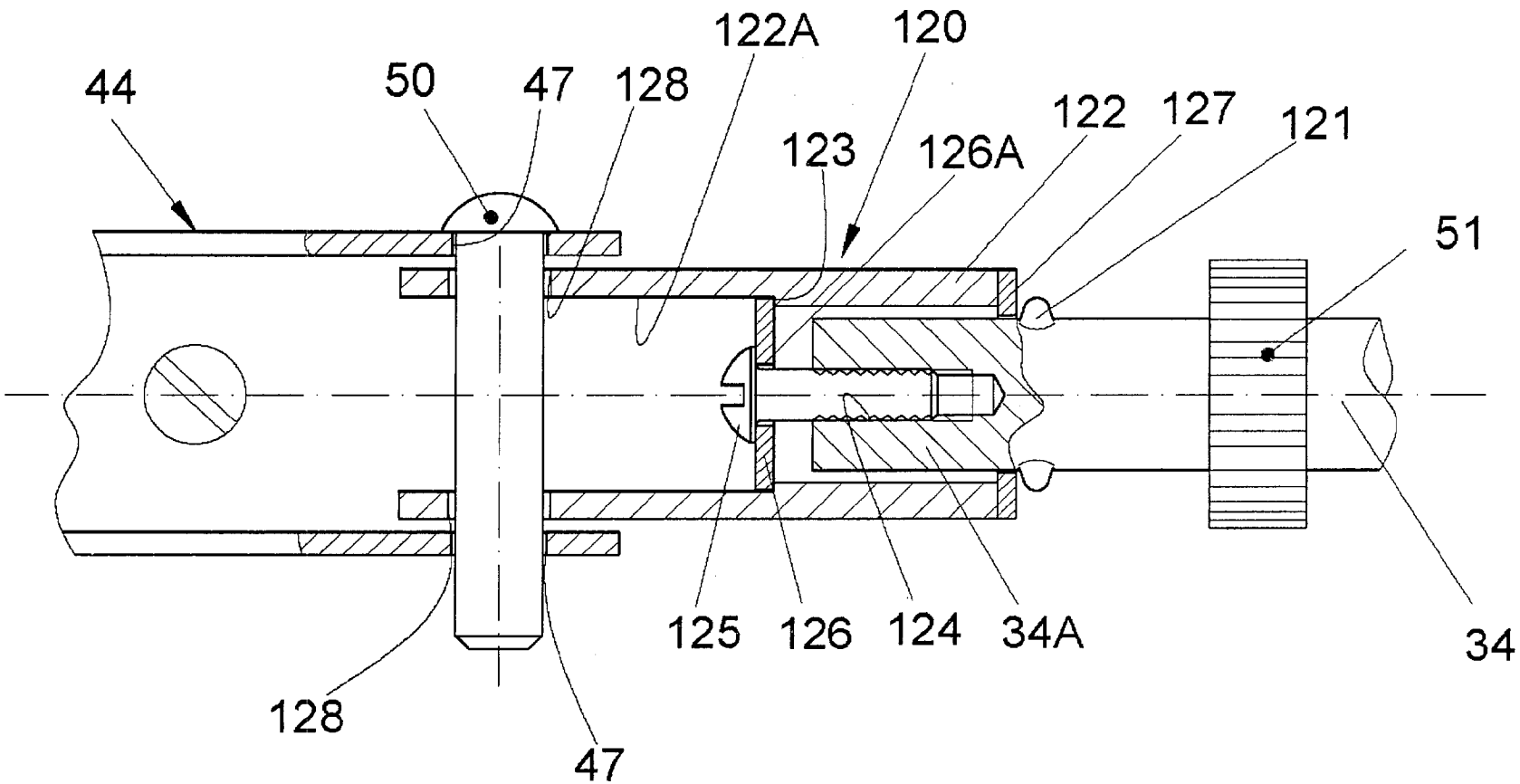
FIG. 8 is a side view of another modified piston rod coupler means having parts shown in section.

FIG. 8 is directed to a further embodiment of a coupling means 120 by which the piston rod 34 may be rotatably supported at its free end 34A relative to its support bracket 44. As shown in FIG. 8, the free end 34A of the piston rod 34 is provided with a shoulder, rim or protuberance 121 to function as a limit or a stop. The coupling means 120 of this embodiment comprises a sleeve or tubular member 122 which is provided with a through bore 122A extending therethrough. The arrangement is such that the free end 34A of the piston rod 34 is inserted into the bore 122A as shown in FIG. 8. As best seen in FIG. 8, the rear end of the piston rod 34 is provided with a tapped hole 124 for receiving a locking screw 125. As shown, a stop washer 126 is positioned against the intermediate shoulder 123 to form a bearing surface for the locking screw 125, which is threaded into the tapped hole 124 formed in the piston rod. It will be noted that the stop washer 126 is provided with an aperture 126A slightly greater than the diameter of the bolt so that the piston rod 34 can be rendered relatively rotatable relative to the sleeve 122. If desired, a washer 127 may be interposed between the end of the sleeve and the protuberance 121. The other end of the sleeve 122 is provided with a pair of aligned apertures 128, 128 which are arranged to be disposed in alignment with the holes 47, 47 of bracket 44. The coupling sleeve 122 is secured to its supporting bracket 44 by the pivot pin or bolt 50. It will be understood that a turn wheel or dial 51 or other means to turn the rod may be suitably connected to the piston rod 34 as hereinbefore described so as to facilitate the rotation of the piston rod 34 to effect any adjustment of the closing speed, as hereinbefore described.

Figure 9:
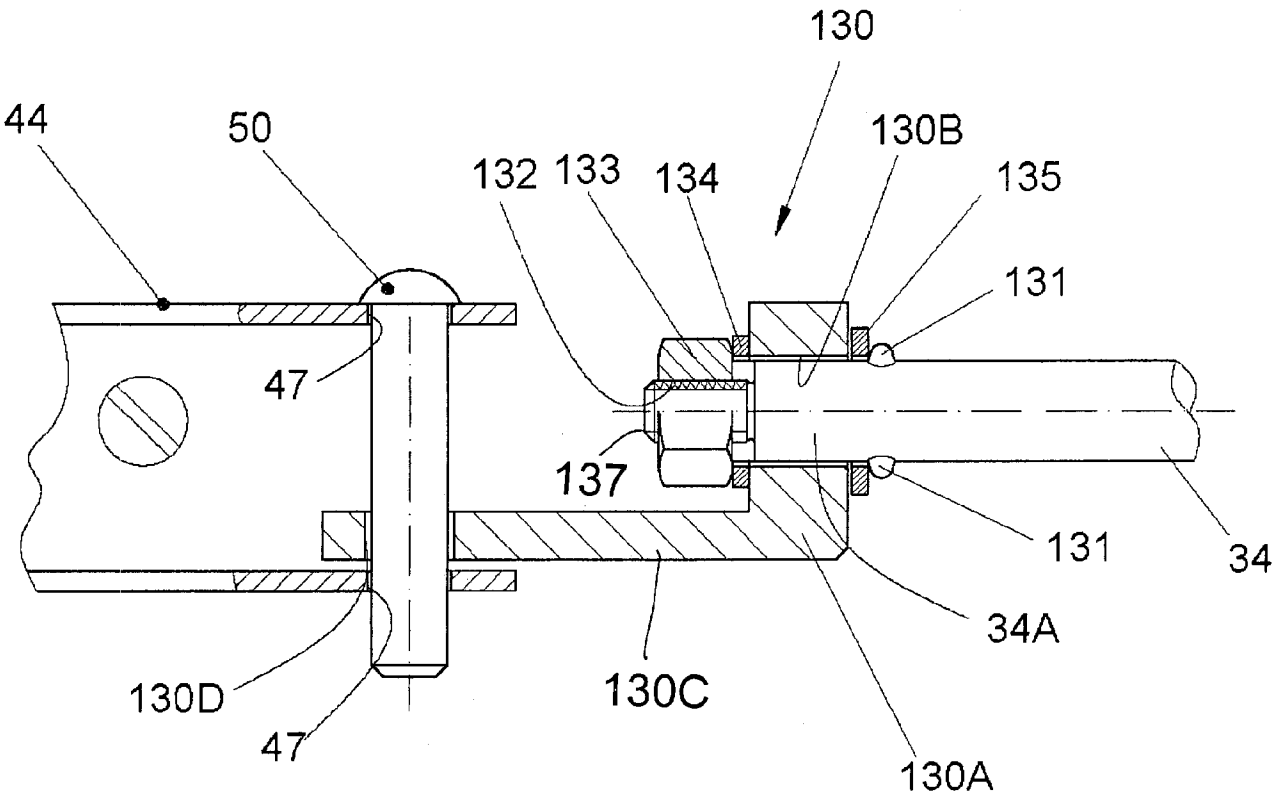
FIG. 9 is a side view of another modified piston rod coupler means having parts thereof shown in section.

FIG. 9 is directed to a door closure assembly as hereinbefore described, with the exception that a modified coupling means 130 is utilized to render the piston rod 34 readily rotatable relative to the coupling means 130. In this form of the invention, the coupling means 130 includes a sleeve portion 130A having a through bore 130B for rotatably receiving the free end 34A of the piston rod 34. In this form of the invention, the piston rod 34 is provided with a rim, protrusion, or shoulder 131 which functions to limit the insertion of the free end portion 34A of the piston rod into the bore 130B of the sleeve 130A. In accordance with this embodiment, the free end 34A of the piston rod 34 is provided with a threaded stub 132 of reduced diameter, whereby the piston rod 34 is rotatably secured to the coupling sleeve 130A by means of a nut 133 threaded on the projected stub 132, or by deforming the head 137 of the sub 132 like in riveting. If desired, suitable washers 134, 135 can be disposed on either side of the sleeve 130B so as to facilitate the ability of the piston rod 34 to rotate within the sleeve 130A. Extended laterally of the sleeve portion 130A of the coupler means 130 is a mounting arm 130C having an aperture 130D formed therein which is arranged to be disposed in alignment with the pin openings 47, 47 of bracket 44. A pivot pin 50 pivotally secures the coupling means 130 to its support bracket 44. As previously described, a turn knob or dial similar to that hereinbefore described may be suitably fixed to the piston rod 34 so as to facilitate the rotation of the piston rod 34 relative to its coupling means 130 to adjust for the desired rate of closing speed, as hereinbefore described.

Figure 11:
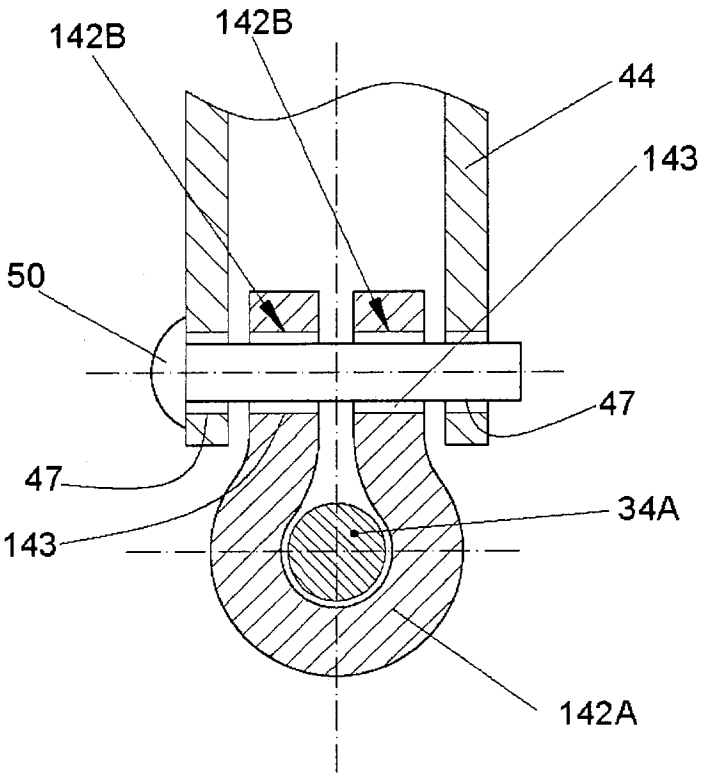
FIG. 11 is a sectional view taken along line 11—11 on FIG. 10.
Figure 10:
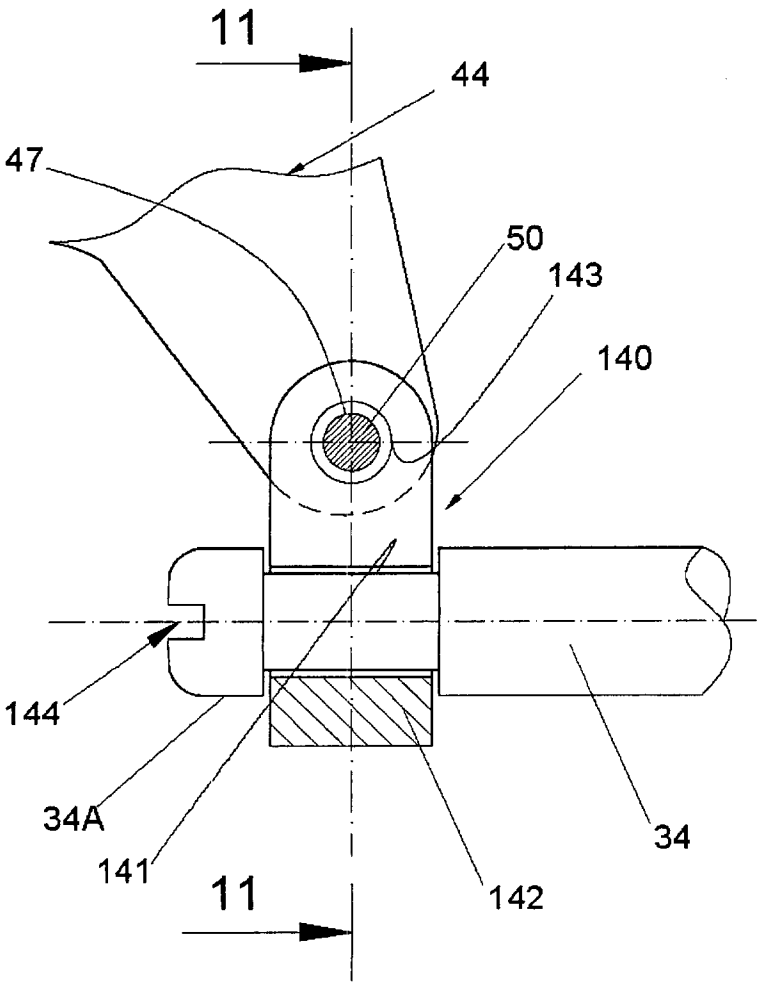
FIG. 10 is a side view of another modified piston rod coupler means having parts shown in section.

FIGS. 10 and 11 are directed to yet another embodiment of a coupling means 140 for rotatably connecting the piston rod 34 to its supporting bracket 44 in a manner that renders the piston rod 34 rotatable relative thereto. In this form of the invention, the piston rod 34 is provided with a relatively wide annular groove 141 adjacent the free end 34A of the piston rod 34. The coupling means 140 comprises a reversely bent strap member 142 formed to define a sleeve portion 142A for receiving the free end 34A of the piston rod 34, the sleeve portion 142A being disposed within the annular groove 141, as best seen in FIG. 10. The coupling strap 142 has a width which is slightly less than the width of the annular groove 141 so that the piston rod 34 is rendered readily rotatable relative to the sleeve portion 142A of the coupling means 140. The ends 142B of the coupling strap 142 are provided with aligned openings 143 which are arranged to be disposed in alignment with holes 47, 47 formed in bracket 44 so that the coupling strap 142 may be pivotally secured thereto by means of a pivot pin, screw or bolt 50. In order to facilitate the rotation of the piston rod 34 relative to the coupling sleeve 142 to effect the adjustment of closing speed, the end of the piston rod 34 is provided with a slot 144 in which a suitable tool, as for example a screw driver, can be used to effect the rotation of the piston rod 34 in one direction or the other in order to effect the adjustments. Alternatively, a dial or wheel 51 may also be used as previously described. In all other respects, the door closure assembly embodying the coupling construction of FIGS. 10 and 11 is identical to that hereinbefore described with respect to the embodiment of FIG. 1.

Figure 13:
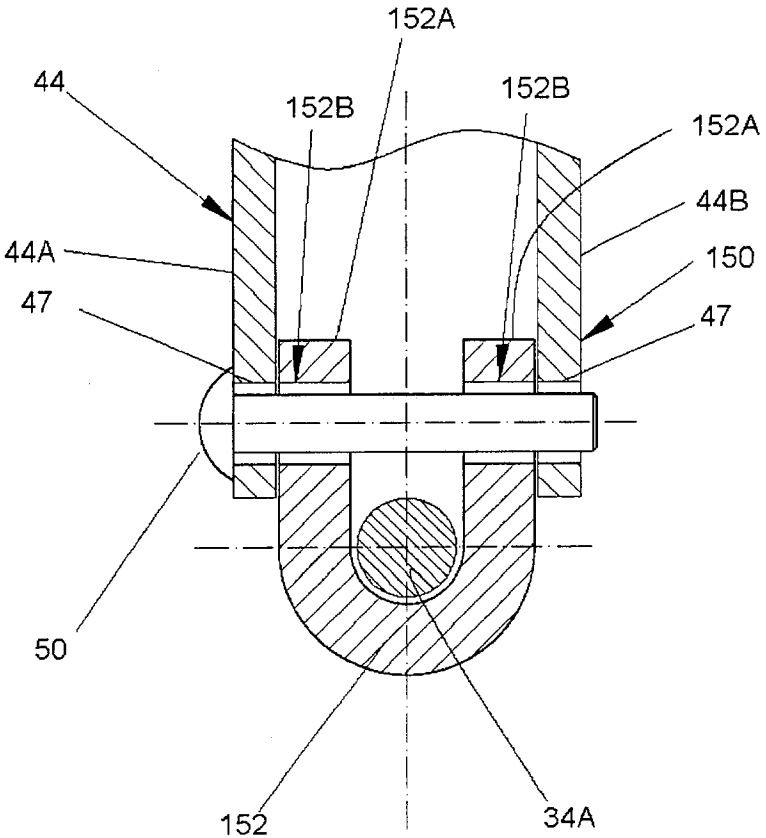
FIG. 13 is a sectional view taken along line 13—13 on FIG. 12.
Figure 12:
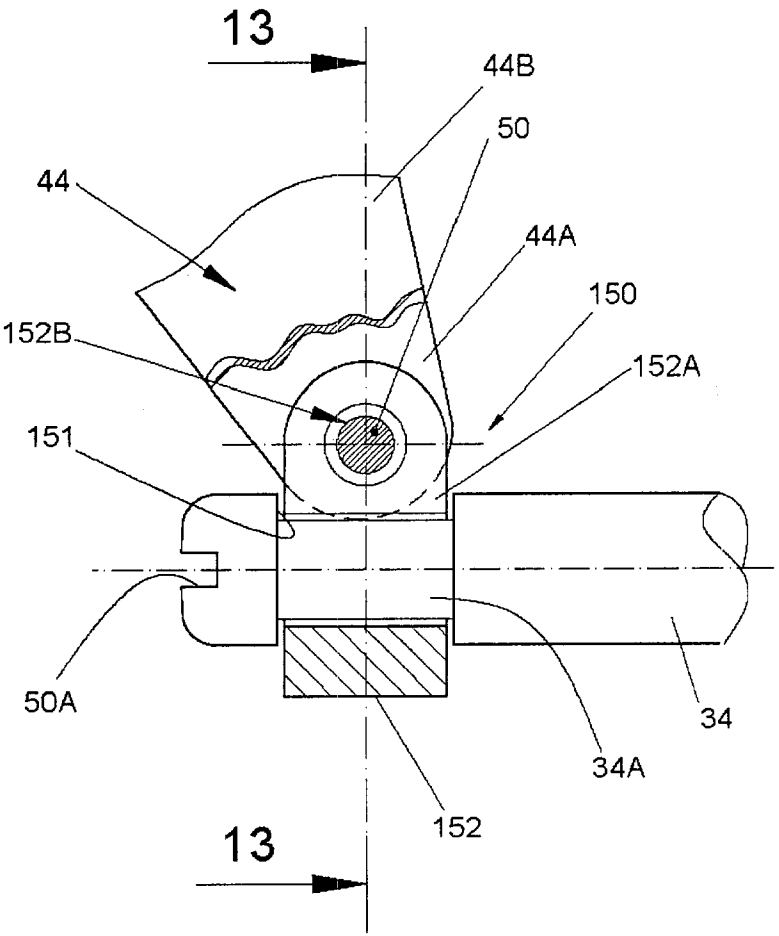
FIG. 12 is a side view of another modified piston rod coupler means having parts shown in section.

FIGS. 12 and 13 illustrate still another embodiment of a coupler means 150 for use in a door closure assembly as hereinbefore described. In this form of the invention, the free end 34A of the piston rod 34 is provided with an annular groove 151 similar to groove 141 described with respect to the embodiment of FIGS. 10 and 11. The coupling means 150 comprises simply a U-shaped strap or member 152 having opposed leg portions 152A, 152A which are provided with aligned pin openings 152B. The U-shaped strap 152 is pivotally secured between the opposed sides of bracket 44 by means of a pivot pin, bolt or screw 50 extending through the aligned openings 47, 47 and 152B, as best seen in FIG. 13. The pivot pin or bolt 50 may be provided with a slot 50A to facilitate rotation of the piston rod 34 by means of a tool such as a screwdriver. In all other respects, the construction of the door closure and its operation are similar to that hereinbefore described.

Figure 14:
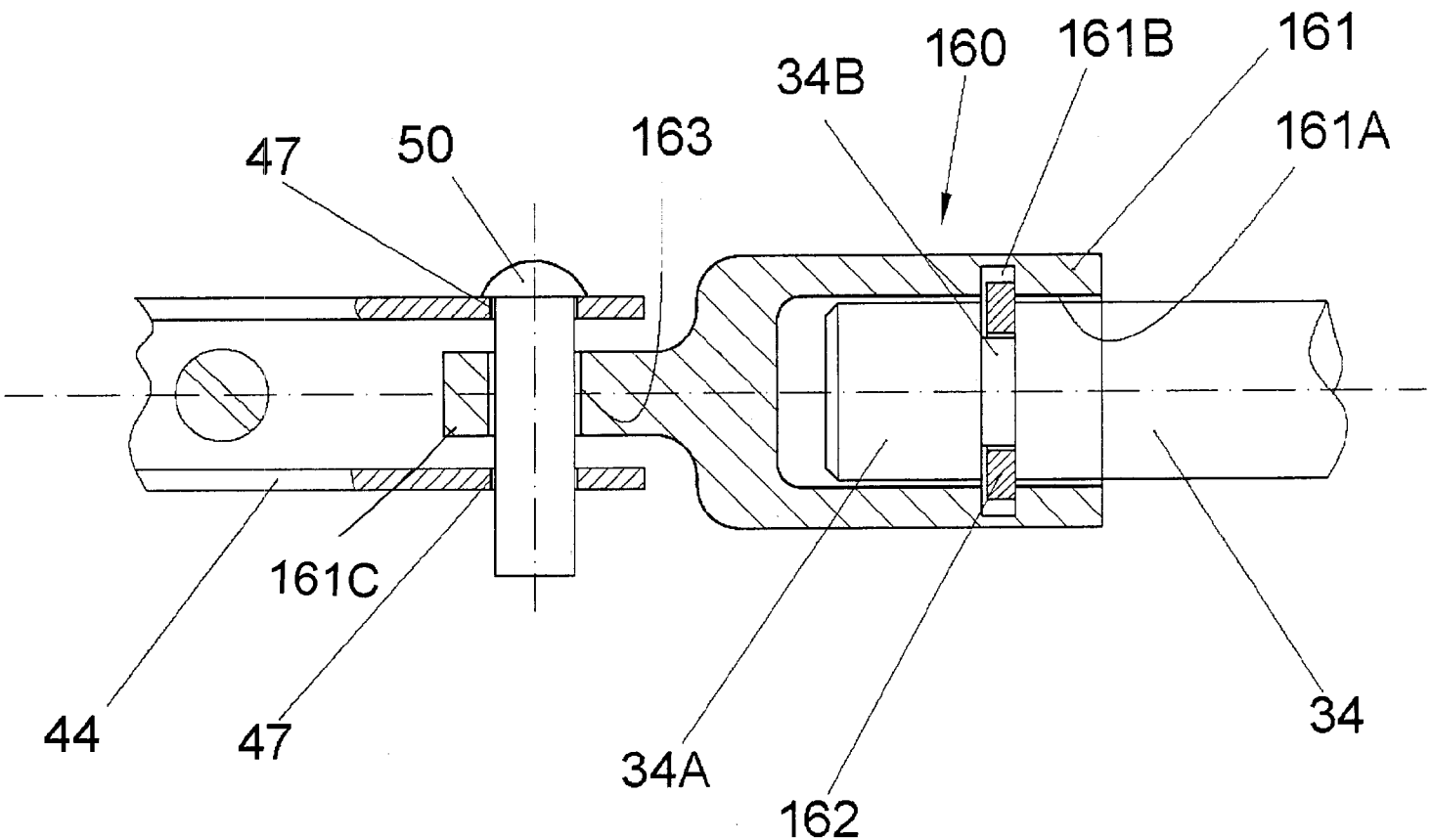
FIG. 14 is a side view of yet another modified piston rod coupler means having parts shown in section.

FIG. 14 is directed to still another modified embodiment of a coupling means 160 for use in a door closure assembly as hereinbefore described. In this form of the invention, the free end 34A of the piston rod 34 is provided with an annular groove 34B. The modified coupling means 160 comprises a socket member 161 having a socket or recess 161A formed on one end for receiving the free end 34A of the piston rod 34. Intermediate the ends of the socket or recess 161A there is provided an annular groove 161B which is arranged to align with the annular groove 34B of the piston rod 34. A retaining means in the form of a retaining ring 162 is arranged to be snap fitted into the aligned grooves 34B and 161B so as to maintain the free end 34A of the piston rod 34 in relative rotatable relationship with respect to the socket 161A. The other end of the coupling means is provided with a mounting lug or tail 161C having formed therein an opening 163 which is arranged to be disposed in alignment with openings 47, 47 of bracket 44. Thus, the coupling means 160 described is pivotally connected to its supporting bracket 44 by means of a pivot pin, bolt or screw 50. In all other respects, the structure and operation of the door closure is similar to that hereinbefore described with respect to the embodiment of FIG. 1.

Figure 16:
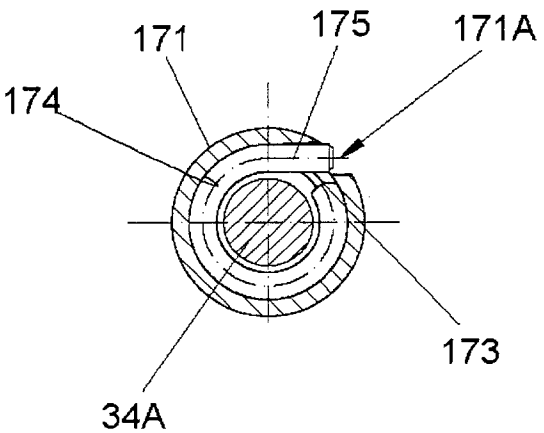
FIG. 16 is a sectional view taken along line 16—16 on FIG. 15.
Figure 15:
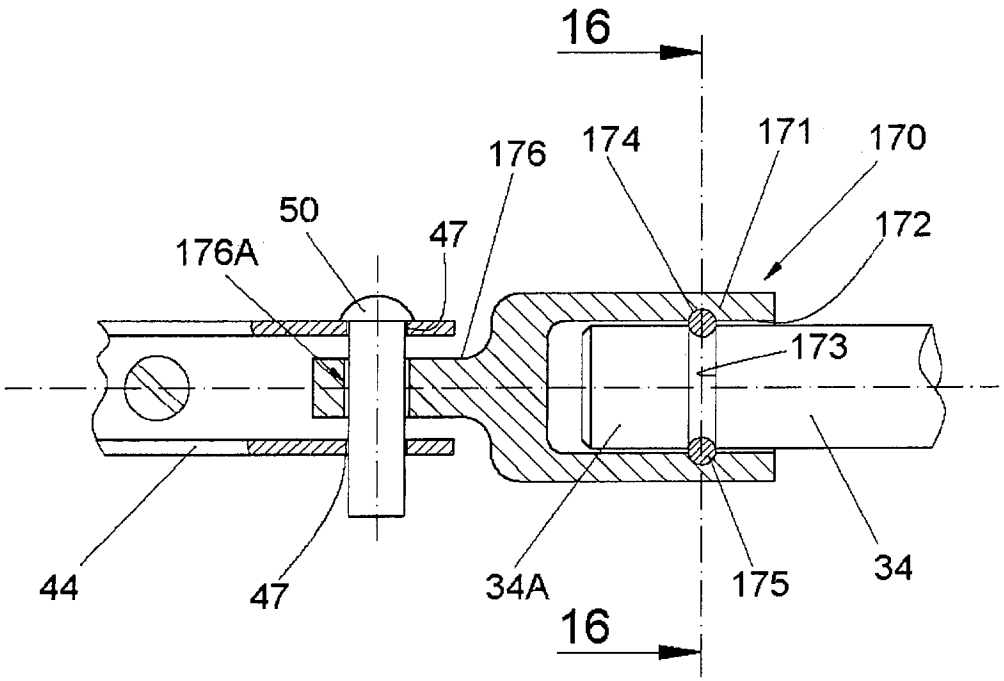
FIG. 15 is a side view of another modified piston rod coupler means having parts thereof shown in section.

FIGS. 15 and 16 are directed to still another embodiment of a coupling means 170 by which the piston rod 34 of the door closure assembly is rendered rotatable relative to its mounting bracket. As illustrated in FIGS. 15 and 16, this is achieved by a coupling means 170 in the form of a socket member 171 having a bore or recess 172 formed in one end, which is arranged to receive the free end 34A of the piston rod. In this form of the invention, the free end 34A of the piston rod is formed with an annular groove 173. Intermediate the length of the coupler socket member 171 there is provided a side opening 171A, as best seen in FIG. 16. The side opening 171A is disposed in alignment with a complementary annular groove 174 recessed into the inner periphery of the bore 172 which compliments the annular groove 173 formed on the free end 34A of the piston rod 34.

In this form of the invention, the piston rod 34 is retained in rotational relationship with respect to the coupler means 170 by means of a retaining wire 175 which is threaded through the side opening 171A and around the complimentary aligned internal grooves 173 and 174. The arrangement is such that the retaining wire 175 loops about the free end 34A of the piston rod 34 within the complimentary grooves 173, 174 to maintain the piston rod in rotatable relationship relative to the socket member 171 and at the same time will prevent any relative longitudinal movement between the piston rod 34 and the coupler means 170. The other end of the coupler 170 means is provided with a projecting lug 176 having an aperture 176A therein which is arranged to be disposed in alignment with openings 47, 47 formed in the supporting bracket 44. A pivot pin or bolt 50 pivotally secures the coupler means 170 to the support bracket 44.

In all other respects, the structure and operation of the door closure embodying the modified coupler means 170 of the embodiment shown in FIGS. 15 and 16 is similar to that hereinbefore described.

Figure 17:
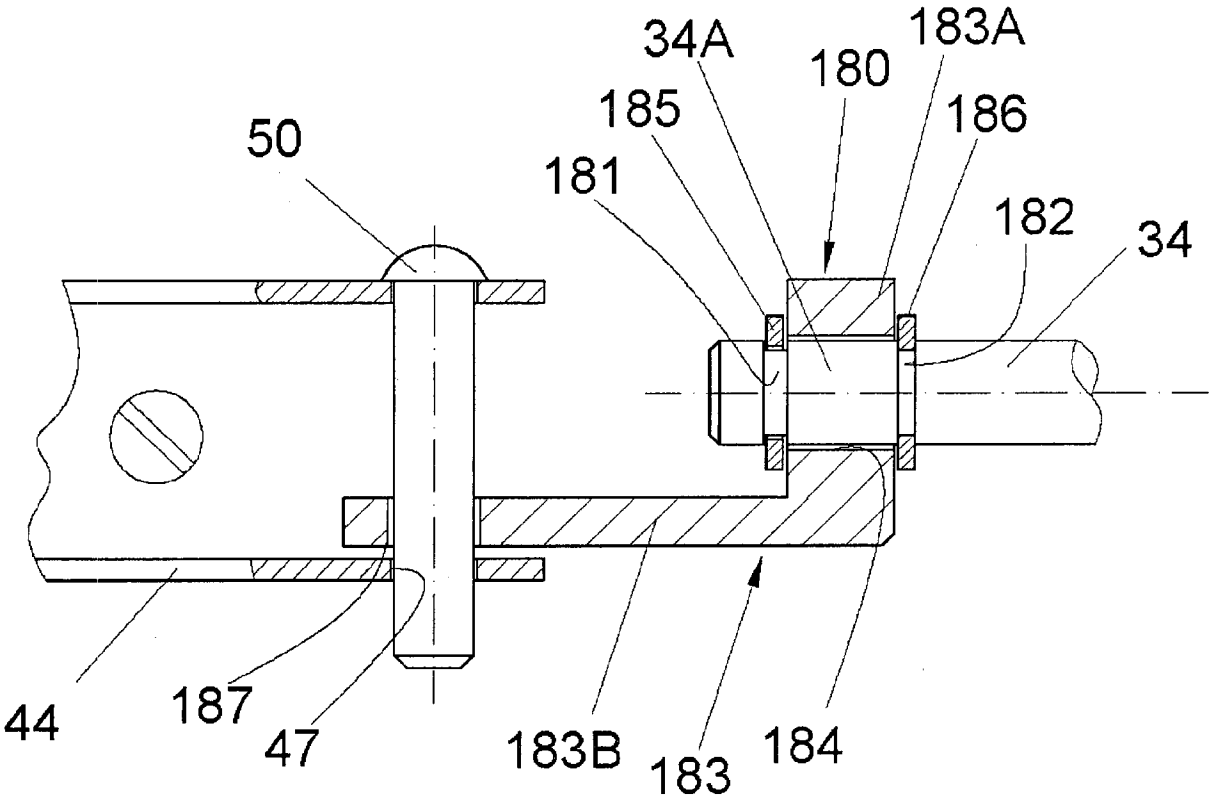
FIG. 17 is a detailed side view of another modified piston rod coupler means.

FIG. 17 is directed to still another modified coupling means 180 by which the piston rod may be rendered rotatable relative to its supporting bracket 44. As seen in FIG. 17, this is attained by providing the free end 34A of the piston rod 34 with a pair of spaced apart annular grooves 181, 182. The coupling means 180 includes a coupler 183 having a sleeve portion 183A provided with a through bore 184 arranged for receiving the free end 34A of the piston rod 34. It is to be noted that the width of the sleeve 183A is slightly less than the distance between the pair of spaced angular grooves 181, 182 formed on the free end 34A of the piston rod 34. A pair of retaining rings 185, 186, disposed on either side of the sleeve 183A, secures the piston rod 34 in a manner so as to prevent any longitudinal displacement between the piston rod 34 and the coupling sleeve 183A while maintaining the piston rod 34 so that it can be readily rotated relative to the coupling member 183. A laterally extending arm 183B is connected to the sleeve whereby the coupling means 180 may be pivotally connected to the supporting bracket 44. The extended arm 183B is provided with an opening 187 which is arranged to be disposed in alignment with openings 47, 47 of bracket 44. A pivot pin, bolt or screw 50 extended through the aligned openings 47, 47 and 185 pivotally supports the coupler means 180 to its supporting bracket 44. If desired, a suitable washer (not shown) may be interposed between the sleeve 183A and the associated retaining rings to facilitate the rotatable relationship between the piston rod and the coupling sleeve 183A. In all other respects, the door closure utilized with the modified coupling means 180 of FIG. 17 is similar in all other respects to that embodiment described with respect to FIG. 1.

Figure 18:
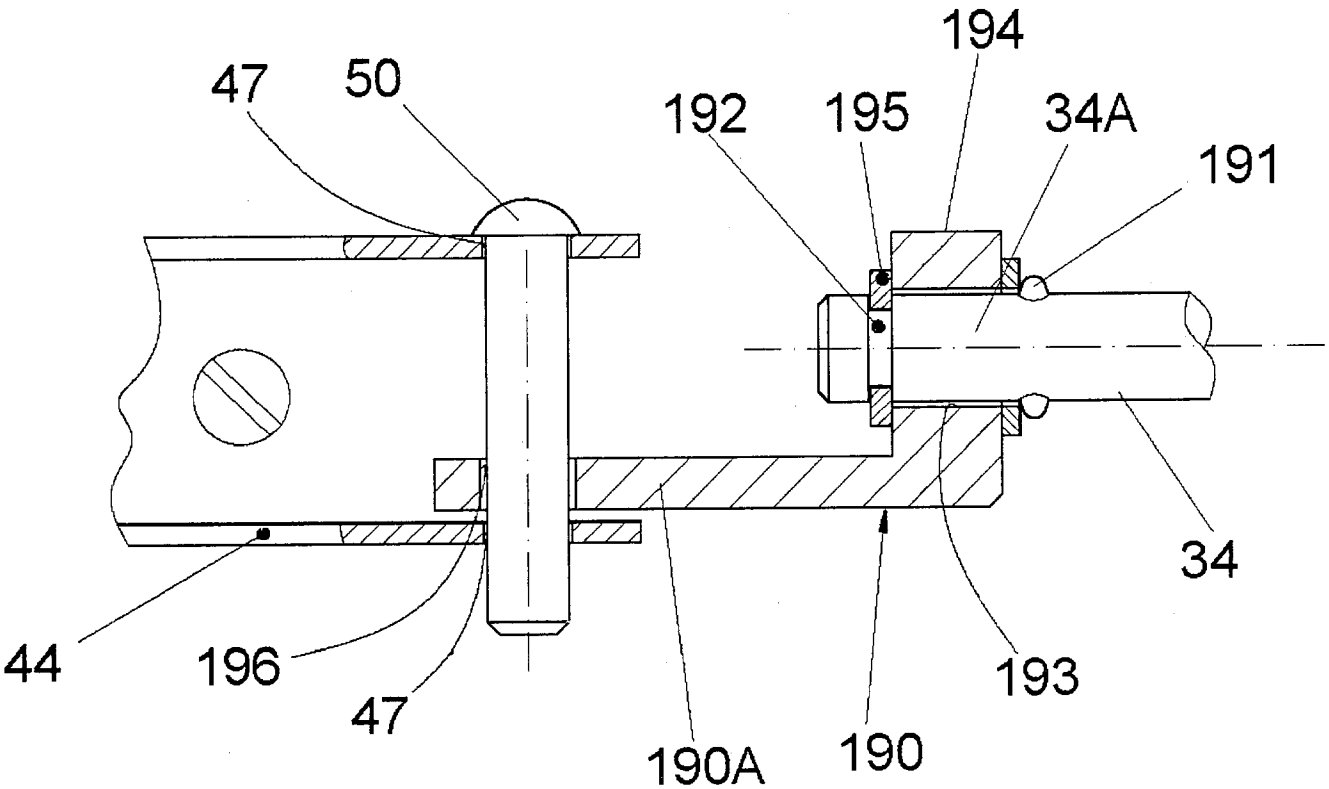
FIG. 18 is a side view of yet another modified coupler means having parts shown thereof in section.

FIG. 18 illustrates a slightly modified version of a coupler means 190 by which the piston rod 34 is rendered rotatable relative to its associated coupling means and supporting bracket. In this form of the invention, the piston rod 34 is provided with a rim, shoulder, ridge or protuberance 191 formed on the free end 34A of the piston rod 34. Longitudinally spaced from the rim or protrusions 191 and nearer to the end of the rod 34, there is formed an annular groove 192. The piston rod 34 is sized to be received in the bore 193 of the coupling sleeve portion 194, as best seen in FIG. 18. To prohibit any relative longitudinal movement between the piston rod 34 and the coupling sleeve 194, a stop means in the form of a ridge, protuberance or rim 191 is provided to preclude any relative longitudinal movement between the coupling means 190 and the piston rod 34. A retainer or split ring 195 is arranged to be snap fitted into the annular groove 192, as best seen in FIG. 18, to secure the piston rod in a manner which permits relative rotation of the piston rod 34 and prohibits any relative linear movement along the piston rod. Connected to the sleeve portion 194 of the coupling means 190 is a laterally extending arm or lug 190A, which has an opening 196 formed therein which is adapted to be disposed in alignment with openings 47, 47 of the supporting bracket 44, as hereinbefore described. The coupling means 190 is pivotally secured to bracket 44 by means of a pivot pin, bolt or screw 50 which is extended through the aligned openings 47, 47 and 196. In all other respects, the structure and function of the door closure assembly utilizing the coupling means 190 of FIG. 18 is similar to that hereinbefore described with respect to FIG. 1.

Figure 19:
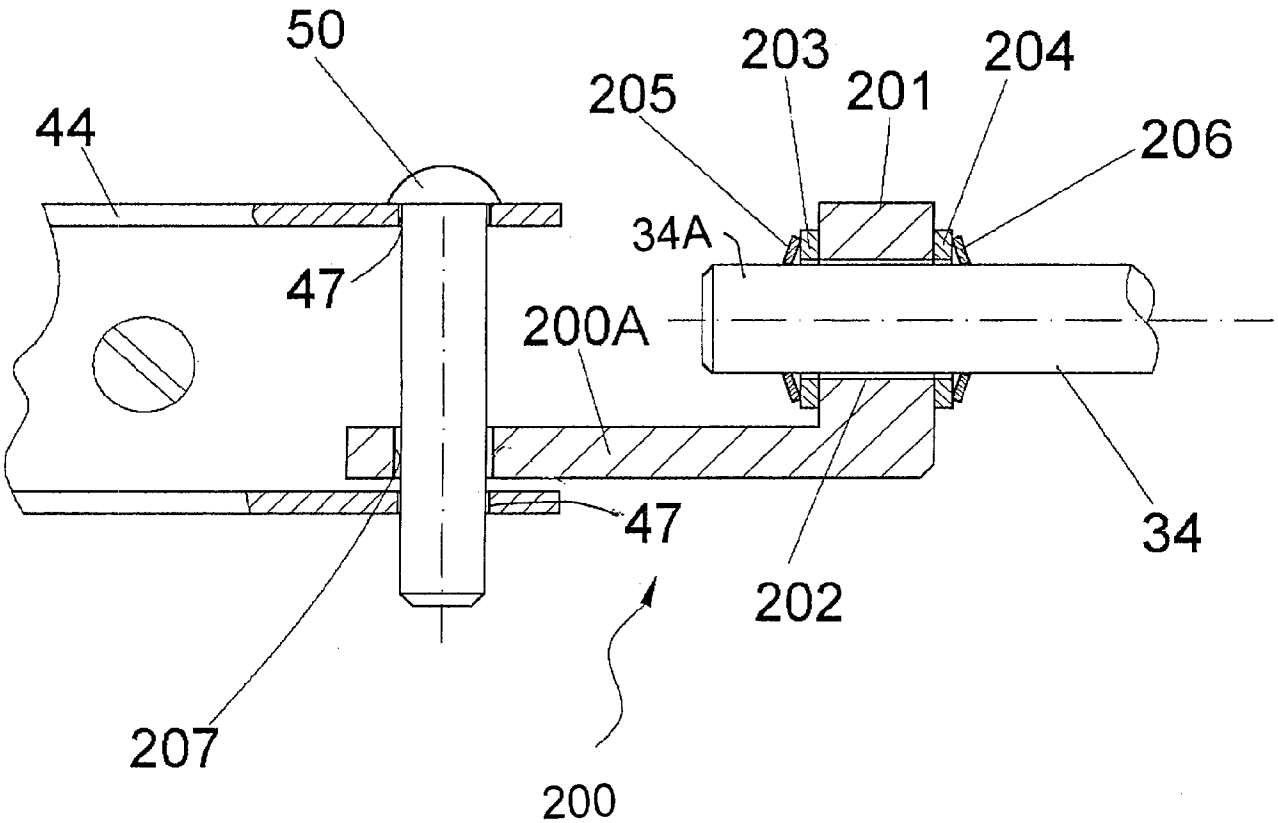
FIG. 19 is a side view of another modified coupler means having parts thereof shown in section.

FIG. 19 illustrates a further modified embodiment of a coupling means 200 for use in combination with the door closure having a piston and cylinder assembly as hereinbefore described. In this form of the invention, the coupling means 200 comprises a sleeve 201 having a through bore 202 extending therethrough, which is arranged for receiving the free end 34A of the piston rod 34. In this form of the invention, the piston rod 34 is maintained in relative rotational relationship relative to the coupling sleeve 201 by providing suitable washers 203, 204 on either side of the coupling sleeve 201. The free end 34A of the piston rod 34 is extended through the bore 202 of the coupling sleeve 201 and is restrained from relative longitudinal movement by securing the piston rod to the coupling sleeve by means of an arcuate gripping or locking washer 205, 206 located on the piston rod on either side of the sleeve. It will be noted that the diameter of the sleeve bore 202 is slightly greater than the diameter of the piston rod 34. The arrangement is such that the piston rod is rendered readily rotatable relative to the coupling sleeve 201. A laterally extending arm or lug 200A having an aperture 207 therethrough is rendered pivotally connected to its supporting bracket 44 by means of a pivot pin, screw or bolt 50. In this form of the invention, it will be apparent that the piston rod 34 is rendered rotatable relative to its coupling sleeve 201. In all other respects, the door closure utilizing the coupling means 200 of FIG. 19 is identical in function and structure to that described with respect to the door closure of FIG. 1.

Figure 20:
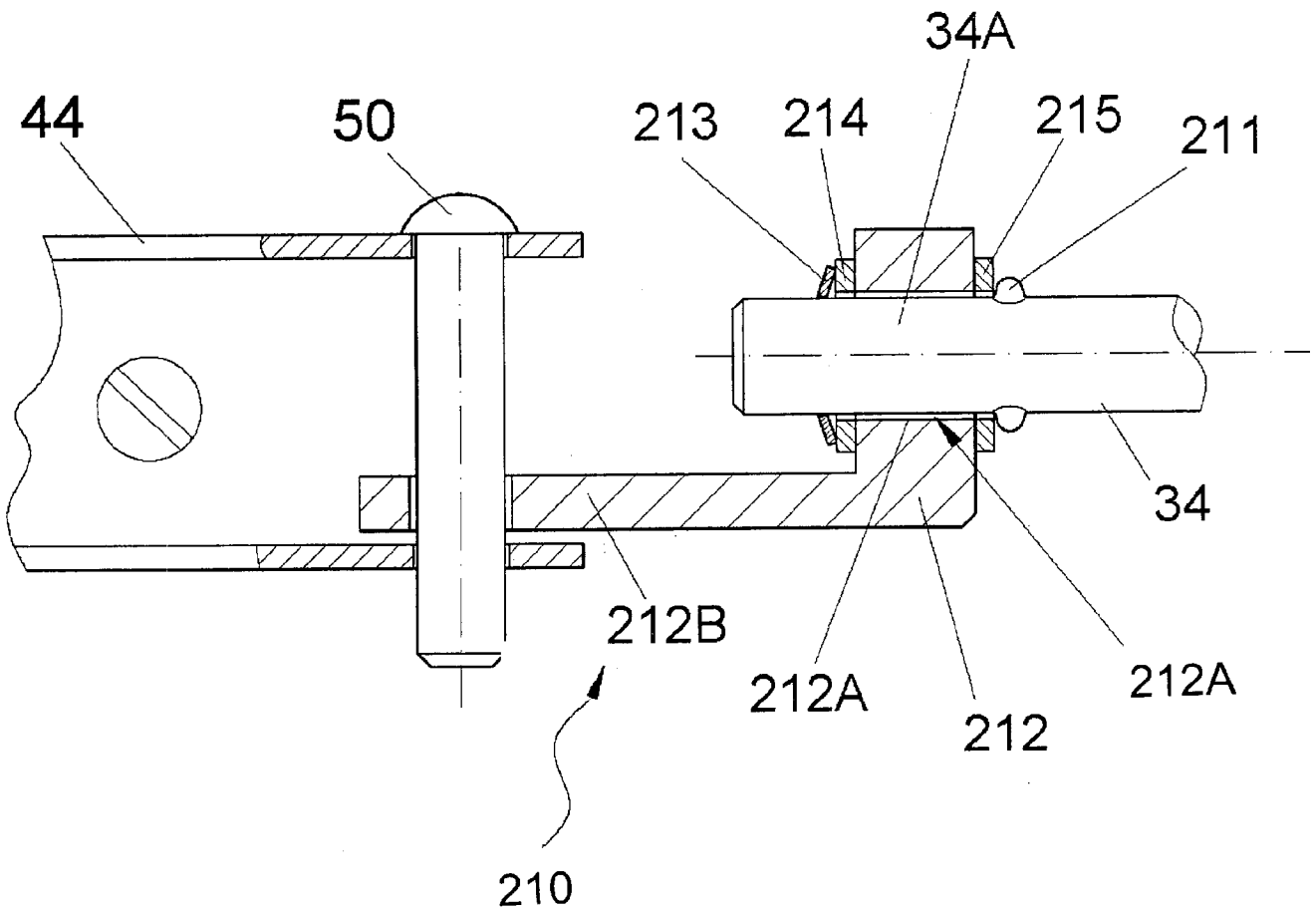
FIG. 20 is a side view of another modified piston rod coupler means having portions thereof shown in section.

FIG. 20 illustrates a further modification of a coupling means 210 for use with a door closure assembly as hereinbefore described. In this form of the invention, the piston rod 34 is provided with a stop rim, shoulder or protrusion 211 adjacent the free end 34A of the piston rod 34. The coupling means 210 includes a sleeve portion 212 having a through bore 212A for receiving the free end 34A of the piston rod 34. The piston rod 34 is restrained from longitudinal movement relative to the coupling means by means of a gripping or lock washer 213. The arrangement described provides rotation of the piston rod 34 relative to the coupler sleeve 212 while restraining or restricting any relative longitudinal movement therebetween. Connected to the sleeve portion 212 of the coupling means 210 is a laterally extending arm 212B by which the coupling means 210 may be pivotally connected to its supporting bracket 44. A pivot pin, bolt or screw 50 maintains the coupler means 210 pivotally connected to its supporting bracket in a manner similar to that hereinbefore described with respect to FIG. 19.

If desired, suitable washers 214, 215 may be interposed on either side of the sleeve portion 212 between the lock washer 213 and the stop rim, protrusion or ridge 211. It will also be understood that a manual turn wheel, dial or screwdriver slot or wrench gripper may be used to effect rotation of the piston rod 34, as hereinbefore described.

With respect to the embodiment of FIG. 9, it will be understood that instead of the nut 133 and threaded stud 132, other suitable fastening means may be employed such as a rivet, screw, bolt and the like to rotatably secure the piston rod to the coupler means.

While various embodiments of the invention have been disclosed and described, it will be apparent that variations and modifications may be made without departing from the spirit or scope of the invention.

What is claimed is:

1. An adjustable door closure for varying the rate of speed at which an associated door may close comprising:

a cylinder, a piston reciprocally disposed within said cylinder, a piston rod having one end thereof connected to said piston whereby said piston rod is rendered longitudinally adjustable relative to said piston, said piston rod having its other end extended beyond one end of said cylinder, a compression spring disposed between said piston and said one end of said cylinder for normally biasing said piston toward a door closing position, means formed on said one end of said piston rod defining at least one adjustable passageway through said piston, a coupler means connected to said other end of said piston rod whereby said piston rod is rendered rotatable relative to said piston and said coupling means to effect the adjustment of the adjustable passageways through said piston.

2. An adjustable door closure as defined in claim 1 and including:

a bracket, said coupler means being pivotally connected to said bracket.

3. An adjustable door closure as defined in claim 1 and including a turn dial fixedly secured to said piston rod to facilitate the rotation thereof.

4. An adjustable door closure for varying the rate of speed at which an associated door may close comprising:

a cylinder having opposed ends, a piston reciprocally disposed within said cylinder, complementary means formed on one end of said piston rod and said piston for adjustably connecting said one end of said piston rod to said piston whereby said piston is rendered longitudinally adjustable relative to said piston rod, means defining a passageway on said one end of said piston rod forming a variable flow path through said piston, said piston rod having the other end thereof extended beyond one end of said cylinder, a compression spring disposed between said piston and said one end of said cylinder normally biasing said piston toward a door closing position, a coupling means, said other end of said piston rod being rotatably coupled to said coupling means so that said piston rod is rendered readily rotatable relative to said piston and said coupling means for adjusting said passageway means to vary the flow path through said piston.

5. An adjustable door closure as defined in claim 4 and including a bracket and means for pivotally connecting the other end of said coupler means to said bracket.

6. An adjustable door closure as defined in claim 4 and including manual means connected to said extended end of said piston rod to facilitate rotation thereof.

7. An adjustable door closure as defined in claim 4 wherein said coupler means comprises:

a member defining a socket for receiving said other end of said piston rod, retainer means for rotatably securing said other end of said piston rod within said socket.

8. An adjustable door closure as defined in claim 7 wherein:

said manual means includes a hub having a bore for receiving said other end of said piston rod, said hub being fixedly secured to said other end of said piston rod, and said coupling means having a shank and connected head, said connected head of said coupler means being secured within the other end of said bore whereby said piston rod is rendered readily rotatable thereto.

9. An adjustable door closure as defined in claim 8 and including a pivot connection connecting said shank to said bracket.

10. An adjustable door closure as defined in claim 4 wherein said coupler means comprises:

a member having a bore receiving said other end of the piston rod, an annular groove formed on said other end of said piston rod, said member including retaining means for engaging said annular groove for rotatably retaining said piston rod within said bore, and said member having a laterally offset portion, a bracket, and a pivot means pivotally connecting said offset portion to said bracket.

11. An adjustable door closure as defined in claim 4 wherein said coupler means comprises:

complementary components shaped to define a socket end for receiving said other end of said piston rod, an annular groove formed on said other end of said piston rod, said components having a retaining lip arranged to engage said annular groove for rotatably connecting said piston rod to said complementary components, and a hub fixedly connected to said other end of said piston rod, said hub having a bore for receiving said complementary components, said components having a mounting end opposite said socket end adapted to be pivotally connected to a support bracket.

12. An adjustable door closure as defined in claim 4 wherein said coupler means comprises:

a member formed of a swagable material defining a socket portion and a connected mounting portion, an annular groove formed on said other end of said piston rod, said socket portion having an inwardly formed lip to define a socket opening, said socket opening being normally enlarged to receive said other end of said piston rod whereby, upon swaging said socket, said lip engages said annular groove for rotatably securing said piston rod to said socket portion.

13. An adjustable door closure as defined in claim 12 and including:

a manual turn dial secured to said piston rod to facilitate rotating said piston rod relative to said piston, a bracket, and a pivot means for pivotally connecting said mounting portion to said bracket.

14. An adjustable door closure as defined in claim 4 wherein said coupling means comprises:

a member having a socket portion and a connected mounting portion, said socket portion having a recess for rotatably receiving said other end of said piston rod, an annular groove formed about said other end of said piston rod, said socket portion having a groove formed about the inner periphery of said recess thereof, said grooves being disposed in concentric alignment, and a retainer means disposed within said aligned grooves to rotatably retain said piston rod relative to said socket portion and to minimize any relative longitudinal movement therebetween, a bracket, and means for pivotally connecting said mounting portion to said bracket.

15. An adjustable door closure as defined in claim 14 wherein said retainer means includes a snap retaining ring.

16. An adjustable door closure as defined in claim 14 wherein said socket portion includes:

a side opening formed in said socket portion, said side opening being disposed in communication with said aligned grooves, and said retainer means comprising a retainer wire projected through said side opening and around the complementary aligned grooves.

17. An adjustable door closure as defined in claim 4 wherein said coupling means includes:

a sleeve portion and a connected mounting arm, said sleeve portion having a through bore adapted to rotatably receive said other end of said piston rod, retaining means for rotatably connecting said other end of said piston rod within the bore of said sleeve portion, said retaining means minimizing any relative longitudinal movement between said sleeve portion and said piston rod.

18. An adjustable door closure as defined in claim 17 wherein said retainer means includes longitudinally spaced apart stops formed on said other end of said piston rod adjacent the opposed ends of said sleeve portion to limit any relative longitudinal movement between said sleeve portion and said piston rod.

19. An adjustable door closure as defined in claim 18 and including a manual turn wheel secured to said piston rod to facilitate rotation thereof.

20. An adjustable door closure as defined in claim 19 and including a washer disposed at either end of said sleeve portion between the end of said sleeve portion and adjacent stop.

21. An adjustable door closure as defined in claim 17 and including:

said other end of said piston rod having a reduced diameter to define a shoulder stop, said reduced diameter of said other end of said piston rod being sized to be received within the bore of said sleeve portion, a stop means on said other end of said piston rod longitudinally spaced from said shoulder stop to confine said sleeve portion therebetween.

22. An adjustable door closure as defined in claim 21 and including a washer disposed between said shoulder stop and said stop means and the corresponding ends of said sleeve portion.

23. An adjustable door closure as defined in claim 17 and including:

a piston rod having a threaded stub projecting from the free end thereof, a stop means formed on said piston rod longitudinally spaced from the free end of said piston rod, said free end of said piston rod being rotatably disposed within said bore of said sleeve portion, and a nut threaded on said stub for retaining said sleeve portion between said nut and stop means.

24. An adjustable door closure as defined in claim 23 and including:

a washer disposed between said nut and stop means and the adjacent corresponding end of said sleeve portion to enhance rotation of said piston rod relative to said sleeve portion.

25. An adjustable door closure as defined in claim 17 wherein:

said piston rod includes a pair of spaced apart annular grooves formed on said free end thereof wherein said spacing between said grooves being substantially equal to the width of said sleeve portion, and a retainer ring disposed in each of said grooves to minimize any relative longitudinal movement between said sleeve portion and said piston rod.

26. An adjustable door closure as defined in claim 17 wherein said free end of said piston includes a stop means and an annular groove longitudinally spaced from said stop means, a retainer ring disposed in said annular groove for retaining said sleeve portion between said stop means and said retainer ring.

27. An adjustable door closure as defined in claim 26 and including a washer disposed between said stop means and the adjacent end of said sleeve portion.

28. An adjustable door closure as defined in claim 17 wherein said retaining means comprise beveled lock washers disposed on each end of said sleeve portion to prohibit any relative longitudinal movement between said sleeve portion and said piston rod.

29. An adjustable door closure as defined in claim 28 and including a washer disposed between the opposed ends of said sleeve portion and the corresponding beveled lock washer.

30. An adjustable door closure as defined in claim 17 wherein:

said free end of said piston includes a stop means for limiting said free end of said piston rod receivable in said bore of said sleeve, and a beveled lock washer for securing said piston rod to said sleeve portion.

31. An adjustable door closure as defined in claim 30 and including a washer disposed on said free end of said piston between the opposed ends of said sleeve portion and its corresponding stop means and lock washer.

32. An adjustable door closure as defined in claim 4 wherein said coupling means comprises:

a reversely bent strap defining a sleeve portion and a connected mounting portion, said piston rod having an annular groove having a width corresponding substantially to the width of said sleeve portion, said grooved portion of said piston rod being rotatably received within said sleeve portion, and a slot formed on the end of said piston rod for receiving a tool to effect rotation of said piston rod relative to said piston.

33. An adjustable door closure as defined in claim 32 wherein said reversely bent strap is U shaped.

34. An adjustable door closure as defined in claim 4 wherein said coupling means comprises:

a tubular member defining a sleeve having a through bore, an internal shoulder formed intermediate the opposed ends of said bore, a tapped hole formed in the free end of said piston rod, stop means formed on said piston rod for limiting the insertion of said piston rod into said sleeve, a stop washer abutting said shoulder within said sleeve, and a lock screw engaging said tapped hole for rotatably supporting said free end of said piston rod relative to said sleeve.

35. An adjustable door closure as defined in claim 34 and including:

a washer interposed between said stop means and adjacent end of said sleeve, a bracket, and means pivotally connecting said tubular member to said bracket.

* * * * *